US007712318B2

(12) United States Patent
Iwasaki

(10) Patent No.: US 7,712,318 B2
(45) Date of Patent: May 11, 2010

(54) COOLING APPARATUS, COOLING METHOD, PROGRAM, COMPUTER READABLE INFORMATION RECORDING MEDIUM AND ELECTRONIC APPARATUS

(75) Inventor: Hiroyuki Iwasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 1406 days.

(21) Appl. No.: 11/103,759

(22) Filed: Apr. 12, 2005

(65) Prior Publication Data

US 2005/0235652 A1 Oct. 27, 2005

(30) Foreign Application Priority Data

Apr. 21, 2004 (JP) ..... 2004-125572
Apr. 6, 2005 (JP) ..... 2005-110214

(51) Int. Cl.
*F25B 21/02* (2006.01)

(52) U.S. Cl. ..... 62/3.7; 62/3.2; 62/3.61

(58) Field of Classification Search ..... 62/3.7, 62/3.6, 3.61, 157, 228.1, 228.4; 385/14; 165/267; 136/203, 204; 318/801–812; 361/22, 361/24, 33–34
See application file for complete search history.

(56) References Cited

U.S. PATENT DOCUMENTS 5,065,593 A * 11/1991 Dudley et al. ..... 62/182
6,370,290 B1 * 4/2002 Ball et al. ..... 385/14
7,047,756 B2 * 5/2006 Getz et al. ..... 62/259.2
2003/0126866 A1 * 7/2003 Spry ..... 62/3.7

FOREIGN PATENT DOCUMENTS

| | | |
|---|---|---|
| JP | 5-28657 | 4/1993 |
| JP | 5-312454 | 11/1993 |
| JP | 6-201215 | 7/1994 |
| JP | 11-88128 | 3/1999 |
| JP | 11-126939 | 5/1999 |
| JP | 11-173727 | 7/1999 |
| JP | 11-289111 | 10/1999 |
| JP | 11-332713 | 12/1999 |
| JP | 2000-220932 | 8/2000 |
| JP | 2002-274907 | 10/2000 |
| JP | 2001-108328 | 4/2001 |

OTHER PUBLICATIONS

Feb. 2, 2010 Japanese official action in connection with counterpart Japanese patent application No. 2005-110214.

* cited by examiner

*Primary Examiner*—Melvin Jones
(74) *Attorney, Agent, or Firm*—Cooper & Dunham, LLP

(57) ABSTRACT

A cooling apparatus of supplying driving power to a cooling element from a power supply unit, to drive it, includes a driving power changing part changing a power value of the driving power supplied to said cooling element from the power supply unit, by a predetermined power value at each predetermined time interval.

21 Claims, 14 Drawing Sheets

COOLING APPARATUS, COOLING METHOD, PROGRAM, COMPUTER READABLE INFORMATION RECORDING MEDIUM AND ELECTRONIC APPARATUS

BACKGROUND

1. Technical Field

This disclosure relates to a cooling apparatus such as a Peltier apparatus applying a cooling element such as a Peltier device, a cooling method, a program, a computer readable information recording medium such as a ROM, and an electronic apparatus such as an image forming apparatus in which the cooling method is applied.

2. Description of the Related Art

Conventionally, a cooling apparatus applying a Peltier device, having a reduced size and including no mechanical moving parts, is therefore employed for avoiding temperature rise otherwise occurring due to heat generated by circuit devices and properly controlling a temperature environment, within an apparatus in which IC devices, electronic devices, electrical components or such are assembled within a narrow space inside of a housing (such an apparatus being referred to as an 'electronic apparatus' hereinafter). For example, Japanese Laid-open Utility-Model Application No. 5-28657 discloses an example in which such a cooling apparatus is applied for cooling a recording sheet in a printer, a facsimile machine or such.

The Peltier device is a device which has a configuration in which PN thermoelectric semiconductors are bounded by cupper electrodes and in which, when a direct-current voltage is applied, heat movement occurs via the bonded surfaces, and thus, a cooling part occurs on one side and a heat generating part occurs on the other side. A common way of driving the Peltier device in the relate art is such that power supply is made by a constant voltage or in a PWM manner. For example, when the Peltier apparatus (device) is applied in an image foaming apparatus such as a copier, a printer or such, a constant DC voltage is supplied from a power supply unit as it is, or, power supply is made in a PWM manner with the use of an FET switching device or such. In a case where a temperature of a control target is measured by a sensor, the power supply is turned on or turned off in such a manner that the detected temperature is controlled for a target value. Specifically, in the PWM operation, setting of a duty is changed so that a cooling performance is changed accordingly.

However, as well known in the art, in a case where the Peltier device is driven in the manner that the power supply is turned on or turned off as mentioned above, degradation of the Peltier device may be accelerated when a temperature difference between a heat generating surface and a heat sink surface of the Peltier device occurs sharply as a result of a large change in the driving voltage being applied. As a result, the life of the Peltier device may be shortened.

Japanese Laid-open Patent Application No. 11-289111 discloses a method for solving this problem of degradation of the Peltier device. In this method, an analog feedback control circuit is provided by which a detected temperature obtained from a sensor which detects a temperature of a cooling target is fed back in such a manner that a power supply voltage to the Peltier device may change in proportion to the detected temperature. Further, in this method, a delay circuit is provided such as to provide a delay when the detected temperature is fed back. Thanks to operation of the control circuit having such a configuration, the driving voltage applied to the Peltier device is prevented from being rapidly changed, the input voltage is prevented from being changed in a step manner also in the PWM operation, and thus, a temperature change on the cooling surface generated in the Peltier device occurring in response to a temperature change in the cooling target is controlled to occur gently. Thus, the cooling operation is carried out in such a manner that rapid heat shrinkage in the Peltier device can be avoided, and thus, performance degradation can be reduced.

However, in the above-mentioned prior art method, the analog feed back control circuit delays the detected temperature of the cooling target as mentioned above. Accordingly, a relatively long time may be required (that is, a follow-up speed is slow) until the applying driving voltage is stabilized into a proper value upon turning-on of the Peltier device (at a time of rising up) or turning-off of the Peltier device (at a time of decaying down), or in response to a sharp temperature change occurring in the cooling target. Therefore, for a case where a subsequent step is executed after this stabilization, processing delay may occur. Further, since this method employs the analog circuit, it may be difficult to carry out adjustment of the performance of the control circuit including adjustment of the sensor for detecting the temperature. the delay circuit, and so forth. As a result, it may be difficult to optimize the circuit performance for each particular apparatus.

Further, in the above-mentioned prior art method, the configuration is provided such that, as mentioned above, the temperature change caused on the cooling surface of the Peltier device is controlled to occur gently. However, the essential factor causing the relevant performance degradation is a sharp occurrence of temperature difference between the heat generating surface and the heat sink surface of the Peltier device. The control in the above-mentioned prior art method may not be directly directed to avoiding this sharp occurrence of temperature difference between the heat generating surface and the heat sink surface of the Peltier device. Accordingly, this method may not be sufficiently effective to solve the relevant problem.

SUMMARY

In an aspect of this disclosure, an apparatus is provided to reduce a degradation otherwise occurring in the Peltier device, and to achieve easier setting of the applying power supply voltage, by which requirements for a relevant apparatus including a requirement for the follow-up speed can be met, for a case where the applying power supply voltage is changed when the driving power for the Pettier device is turned on or turned off, in a Peltier apparatus (cooling apparatus) in which the driving power is supplied to the Peltier device (cooling element) so that the Peltier device is driven, and thus, the control operation can be optimized for each particular apparatus. Further, a cooling method, a program, a computer readable information recording medium, and an electronic apparatus can be provided concerning the above-mentioned cooling apparatus.

In another aspect of this disclosure, there is provided a cooling apparatus of supplying driving power to a cooling element from a power supply unit, to drive it, that includes a driving power changing part changing a power value of the driving power supplied to the cooling element from the power supply unit, by a predetermined power value at each predetermined Lime interval. Further, an electronic apparatus employing the above-mentioned cooling apparatus for keeping a predetermined operation environment includes a sensor detecting the operation environment; and a control part controlling a driving manner of the cooling apparatus.

In another aspect of this disclosure, a cooling method executed by a cooling apparatus which supplies driving power to a cooling element from a power supply unit to drive it, includes a driving power changing step of changing a power value of the driving power supplied to the cooling element from the power supply unit, by a predetermined power value at each predetermined time interval. Further, a program, such as embodied in a computer readable information recording medium, includes instructions for causing a computer to execute respective steps of the above-mentioned cooling method.

In the Peltier apparatus (cooling apparatus) according to an exemplary embodiment of this disclosure, the driving power changing part can change the power value of the driving power to the cooling element at each predetermined time interval by the predetermined power value, and thus control the power value of the driving power for driving the Peltier device (cooling element). Accordingly, it is possible to reduce a change amount in the driving voltage when driving the Peltier device, and thus, to prevent temperature difference between a heat generating surface and a heat sink surface of the Peltier device from occurring sharply. Thereby, it is possible to avoid a degradation otherwise occurring in the Peltier device. Further, by providing a timer to change a setting of the above-mentioned driving control, it is possible to easily optimize the control operation for each particular apparatus (each particular device/element). Further, by applying the Pettier apparatus (cooling apparatus) of this disclosure for keeping an operation environment of an electronic apparatus for predetermined requirements, it is possible to improve the overall performance of the electronic apparatus.

Other aspects and further features of the present invention will become more apparent from the following detailed description when read in conjunction with the accompanying drawings:

DETAILED DESCRIPTION OF THE PREFERRED EMBODIMENTS

Embodiments of a Peltier apparatus according to the present invention are described with reference to figures.

As mentioned above, an object of the present invention is to solve the above-mentioned problem, i.e., to avoid a degradation of a Peltier device, to achieve easier setting of an applying supply power voltage which setting is such as to enable fulfillment of requirements of the apparatus, i.e., the Peltier apparatus, including the follow-up speed requirement, and to optimize control operation for each particular device or for each particular apparatus. The Peltier apparatus is an apparatus employing the Peltier device as an element, and is configured to utilize a cooling function of the Peltier device. In order to achieve the object of the present invention, a driving DC voltage (power supply voltage) applied to the Peltier device is controlled according to predetermined control requirements upon turning on or turning off of the power supply to an electronic apparatus. In this control scheme, basically, two control manners, i.e., an applying voltage changing control manner and a PWM control manner are proposed, in a first embodiment and a second embodiment, respectively, as will be described below. Further, third through eighth embodiments are those concerning configurations in which the Peltier apparatus according to the present invention is applied to an electronic apparatus such as an image forming apparatus.

The first embodiment of the present invention is described.

In this embodiment, as mentioned above, the applying voltage changing control manner is applied, in which the applying voltage for driving the Peltier device is changed.

In this manner, upon turning on or turning off of power supply to an electronic apparatus, the applying voltage to the Peltier device is increased or decreased stepwise. In this control, a time interval for which each level of the applying voltage is output can be set arbitrarily as a control requirement, for the purpose of achieving the above-mentioned object of the present invention to optimize the operation control for each particular apparatus.

Figure 1:
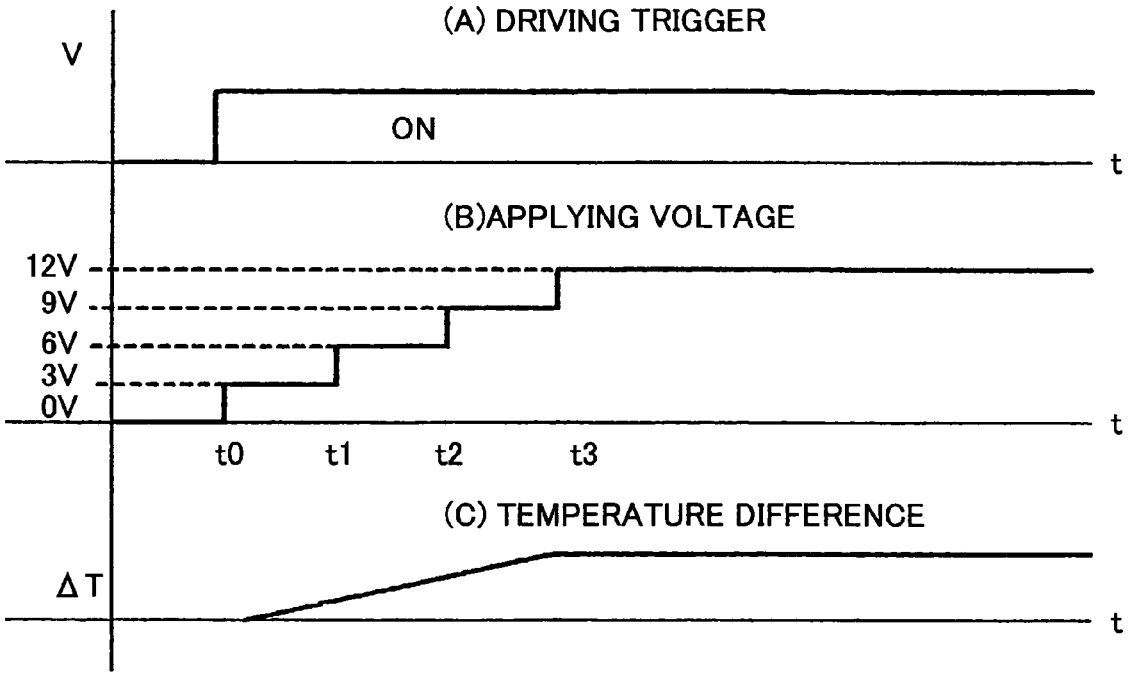
FIG. 1 illustrates a Peltier device driving method (upon power turning on) in an applying voltage changing control manner.

FIG. 1 illustrates operation according to the applying voltage changing control manner, specifically showing a time chart of a change in the applying voltage upon power supply tuning on, and a change of a temperature occurring from the Peltier device in response thereto. As shown in FIG. 1, (A), which shows a driving trigger signal for the Peltier device, a rising up (switching) of the driving trigger signal is applied as a trigger. FIG. 1, (B) shows the applying voltage (driving power) for driving the Peltier device. In this example, the voltage value is increased stepwise by 3 V every step for a final target value (12 V). Thereby, the power value of the driving power increases stepwise, and thus, a temperature difference between a heat generating surface and a heat sink surface of the Peltier device increases accordingly. FIG. 1, (C)

shows the temperature difference ΔT between the heat generating surface and the heat sink surface of the Peltier device.

By preventing this temperature difference ΔT from increasing sharply, it is possible to reduce a degradation occurring in the Peltier device, which is the object of the present invention as mentioned above. For this purpose, the output time interval for keeping each output level of the applying voltage shown in FIG. 1, (B) every step is set appropriately in such a manner that the temperature change ΔT may occur gently. Then, operation according to the thus-obtained setting is carried out. Specifically, first, it is assumed that the above-mentioned trigger (rising up of the driving trigger signal shown in FIG. 1, (A)) occurs at a time t0, and respective times at which the applying voltage is switched to the subsequent one for increasing the applying voltage stepwise are t1, t2 and t3, as shown in FIG. 1, (B). For example, setting is made as follows: t1−t0=20 [secs]; t2−t1=15 [secs]; and t3−t2=10 [secs]. Thereby, it is possible to obtain a gentle increasing slope of the temperature difference ΔT as shown in FIG. 1, (C) in which the temperature difference is prevented from increasing sharply. By thus increasing (changing) the power value of the driving power by the predetermined power value at each predetermined time interval, it is possible to obtain the desired gentle manner of change in the temperature difference ΔT.

Figure 2:
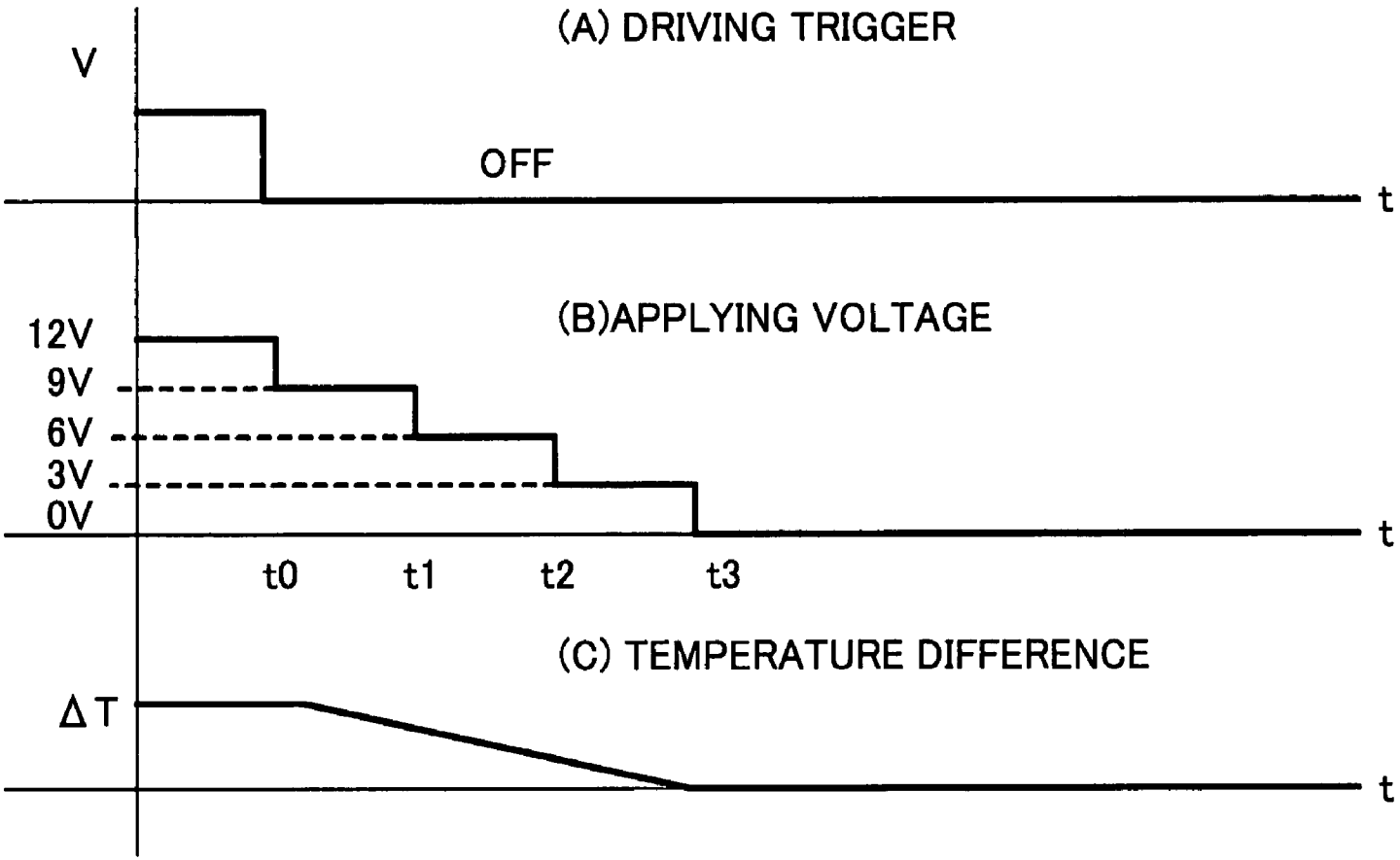
FIG. 2 illustrates a Peltier device driving method (upon power turning off) in the applying voltage changing control manner.

FIG. 2 illustrates operation according to the applying voltage changing control manner, specifically showing a time chart of a change in the applying voltage upon power supply tuning off, and a change of a temperature occurring from the Peltier device in response thereto. As shown in FIG. 2, (A), which shows a driving trigger signal for the Peltier device. A decaying down (switching) of the driving trigger signal is applied as a trigger. FIG. 2, (B) shows the applying voltage (driving power) for driving the Peltier device. In this example, the voltage value is decreased stepwise by 3 V every step for a final target value (0 V). Thereby, the power value of the driving power decreases stepwise, and thus, a temperature difference between the heat generating surface and the heat sink surface of the Peltier device decreases accordingly. FIG. 2, (C) shows the temperature difference ΔT between the heat generating surface and the heat sink surface of the Peltier device.

By preventing this temperature difference ΔT from decreasing sharply, it is possible to reduce a degradation occurring in the Peltier device, which is the object of the present invention. For this purpose, an output time interval for keeping each output level of the applying voltage shown in FIG. 2, (B) in each step is set appropriately in such a manner that the temperature changes ΔT may occur gently. Then, operation according to the thus-obtained setting is carried out. Specifically, it is assumed that the above-mentioned trigger (decaying down of the driving trigger signal shown in FIG. 2, (A)) occurs at a time t0, and respective times at which the applying voltage is switched to the subsequent one for decreasing the applying voltage stepwise are t1, t2 and t3, as shown in FIG. 2, (B). For example, setting is made as follows: t1−t0=10 [secs]; t2−t1=15 [secs]; and t3−t2=20 [secs]. Thereby, it is possible to obtain a gentle decreasing slope of the temperature difference ΔT as shown in FIG. 1, (C) in which the temperature difference is prevented from decreasing sharply. By thus decreasing (changing) the power value of the driving power by the predetermined power value at each predetermined time interval, it is possible to obtain the desired gentle manner of change in the temperature difference ΔT.

Figure 3:
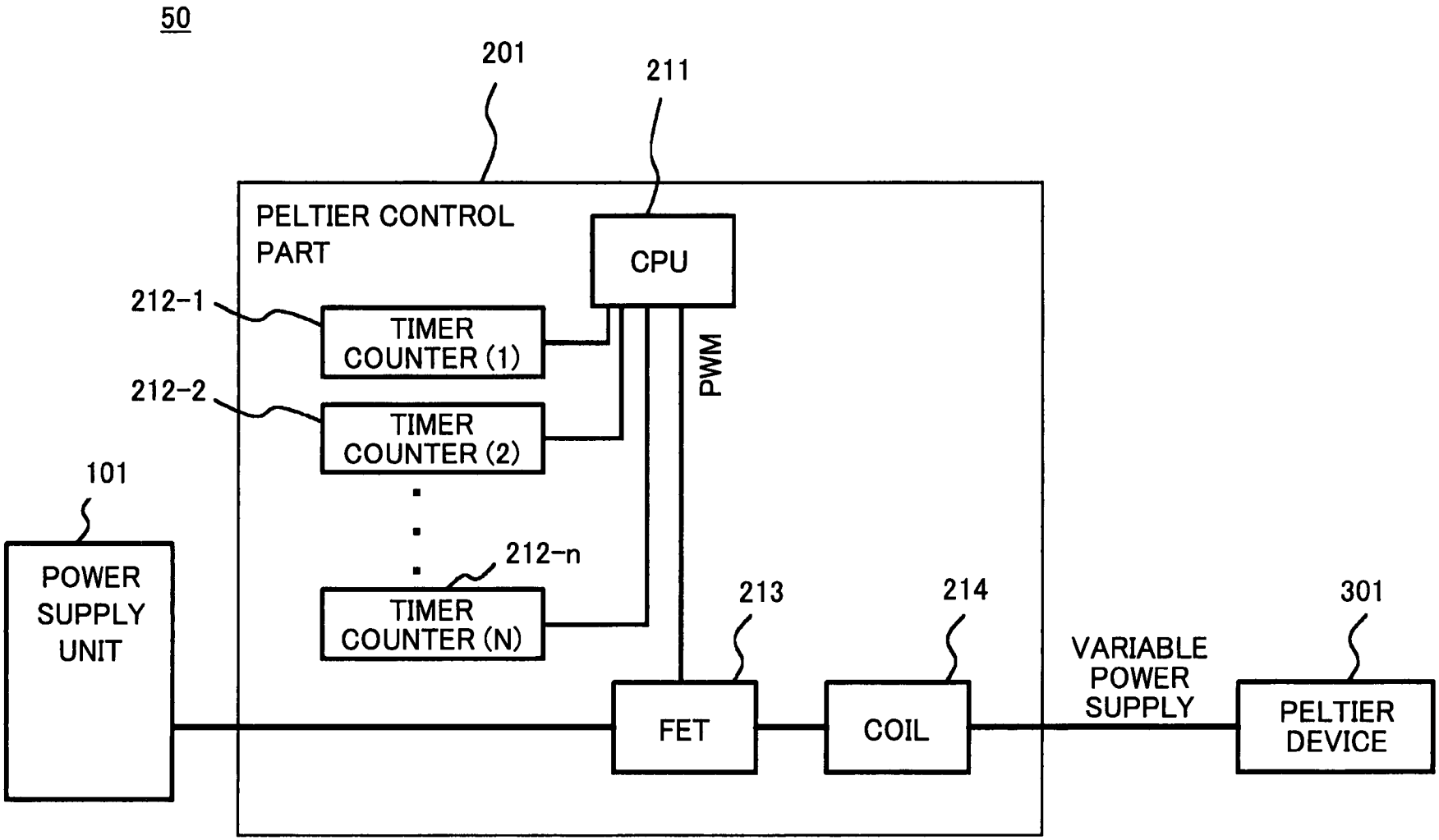
FIG. 3 shows an embodiment of a driving part of a Peltier apparatus in the applying voltage changing control manner.

FIG. 3 shows an embodiment of a Peltier device driving part in a Peltier apparatus for carrying out the above-described operation (see FIGS. 1 and 2) according to the applying voltage changing control manner.

As shown in FIG. 3, the driving part of the Peltier apparatus includes a power supply unit 101 and a Peltier control part 201. The Peltier control part 201 controls a driving DC voltage supplied by the power supply unit 101 for the purpose of providing a variable voltage for driving the Peltier device 301. That is, the driving power supplied by the power supply unit 101 to the Peltier device 101 is appropriately controlled. The Peltier control part 201 includes a control part including a CPU 211 and timer counters 212-1 through 212-n corresponding to respective ones of the variable voltage; and a power supply voltage decaying circuit including an FET 213 and a coil 214 by which the output voltage to the Peltier device 301 is controlled according to a control signal from the CPU 211.

The CPU 211 includes, as well-known in the art for achieving a control function in various types of electronic apparatuses, a ROM or a RAM (not shown) under the control of the CPU, and operate according to instructions written in a predetermined program for controlling driving of the Peltier device 301. When power supply is turned on and the electronic apparatus is started up, or the electronic apparatus is stopped by turning off of the power supply thereto, the Peltier apparatus provided in the electronic apparatus is started up or stopped accordingly. For this purpose, an instruction is provided to the Peltier apparatus. In response thereto, the CPU 211 starts up the program and operates according to the instructions written in the control program stored in the ROM, for example, a program for carrying out a control flow (see FIG. 4) for applying the variable voltage for driving the Peltier device 301, as described later. Then, the CPU 211 controls driving of the Peltier device 301 according to the program.

Operation of controlling the applying voltage for driving the Peltier device 301 in the Peltier control part 201 is carried out as follows: That is, according to the control program, the CPU 211 outputs a predetermined PWM signal to the FET 213, and thereby, output of the voltage decaying circuit including the FET 213 and the coil 214 is controlled in such a manner that the output voltage is obtained in proportion to a duty of the PWM signal. The duty of the PWM signal means a pulse modulation factor, that is, actually, a ratio of a turn-on duration to a modulation period in the PWM signal.

At this time, according to the embodiment of the present invention, each output time interval of the PWM signal corresponding to the variable voltage applied to the Peltier device 301 is controlled. For this purpose, the timer counters 212-1 through 212-n are provided for counting or measuring the respective ones of the output time intervals corresponding to the number of the respective PWM signals corresponding to the output steps (n times). A time interval setting can be made for each timer counter thereof to an arbitrary value. The CPU 211 manages the output time for each level of the above-mentioned stepwise control of the variable voltage (see FIG. 1 or 2) by means of the group of the timer counters 212-1 through 212-n, and thus, the CPU 211 can control a time interval for applying each step of the variable voltage.

This group of the timer counters 212-1 through 212-n are applied for the starting up (turning on) process (see FIG. 1) and for the stopping (turning off) process (FIG. 2). However, since these processes should not occur simultaneously, it is possible to apply the timer counter group in common for each of both processes. For example, as in the example of FIGS. 1, (B) and 2, (B), in which the respective time intervals are common for both processes, the timer counters can be applied without changing the time interval settings thereof. Thereby, it is possible to simplify the system.

A control flow of driving of the Peltier device 301 carried out by the CPU 211 of the above-described control part 50 shown in FIG. 3 according to the control program is described now.

Figure 4:
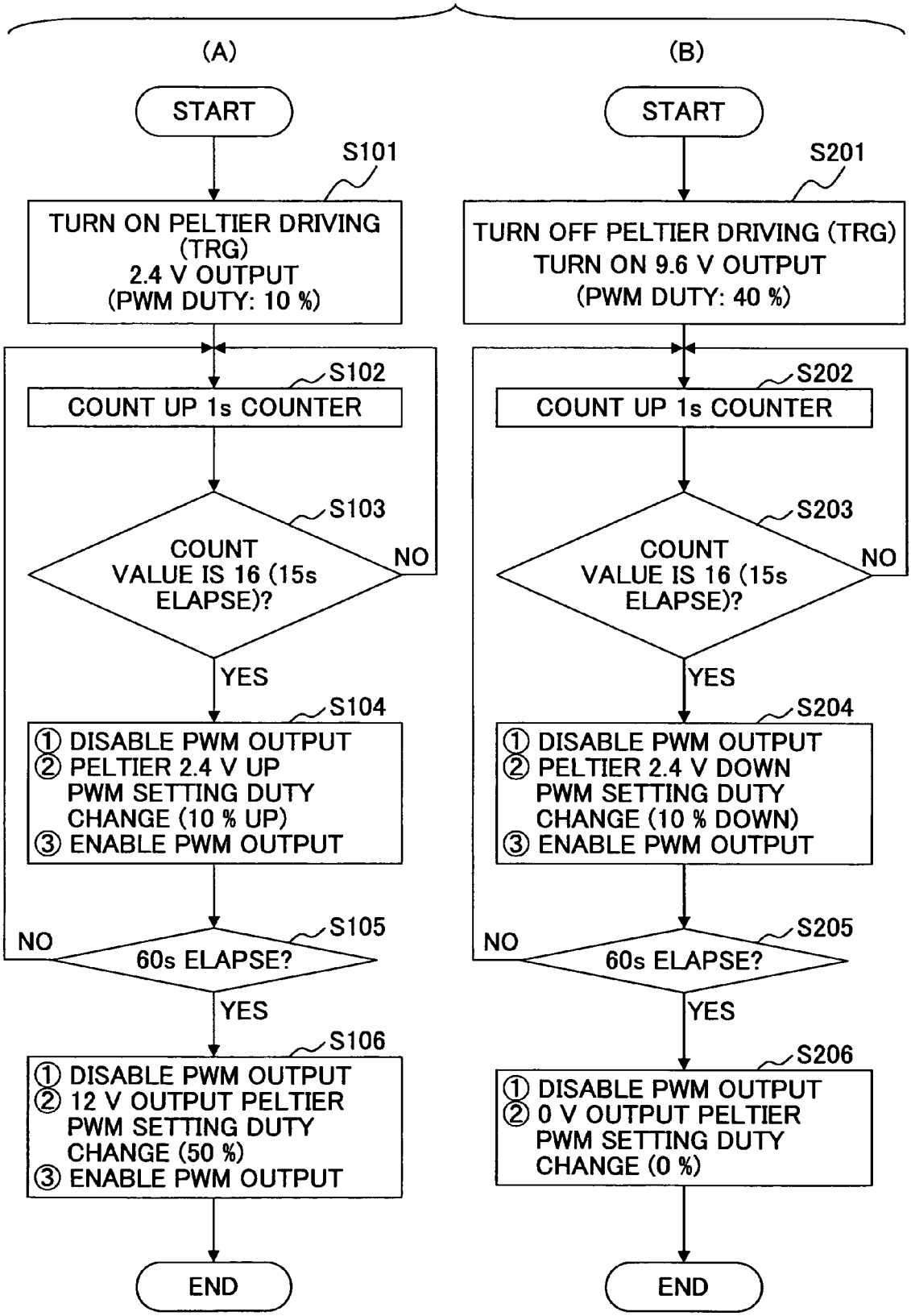
FIG. 4 shows a Peltier device driving control operation flow chart in the applying voltage changing control manner.

FIG. 4 shows the control flow of driving of the Peltier device 301. FIG. 4, (A) shows the control flow for the power supply turning on process while FIG. 4, (B) shows the control flow for the power supply turning off process.

It is noted that, the power supply turning on process is carried out when the electronic apparatus such as an image forming apparatus is turned on. Upon turning on of the electronic apparatus, generation of a heat from various parts as described later is started. The Peltier apparatus according to the embodiment of the present invention is provided to control the thus generated heat or humid air so as to keep the temperature or humidity environment in the electronic apparatus at a predetermined level. In the same line, the power supply turning off process is carried out when the electronic apparatus is turned off. Upon turning off of the electronic apparatus, the heat or humid air is no more generated, and thus, the cooling function of the Peltier device 310 is no more required.

As described above, in the Peltier device driving method in the present embodiment, the applying voltage is controlled by the control of the duty of the PWM signal. This value of the duty of the PWM signal is referred to as the 'PWM duty', hereinafter. Specifically, the PWM duty is changed 10% every step, the applying voltage is changed by 2.4 volts every step accordingly, and the PWM duty of 50% is set for a completely started up state while the PWM duty of 0% is set for a completely stopped down state. Further, the respective times at which the PWM duty is switched (t1, t2 and t3 in the example of FIG. 1, (B) or FIG. 2, (B)) are set in such a manner that each switching is carried out at a time interval of 15 seconds every step. Accordingly, the completely starting up is achieved for a total 60 seconds from the turning on trigger or the completely stopping down is achieved for a total 60 seconds from the turning off trigger. In the present embodiment, the respective times at which the duty of the PWM signal, i.e., t1, t2, t3, . . . tn are obtained from the respective settings of the timer counters 212-1 through 212-n, provided for the number of the output steps. However, for a case where the time interval between the applying voltage switching operations is fixed as 15 seconds every step as mentioned above, it is possible to apply a common timer counter therefor. However, in such a case, another timer counter is required for setting the completion timing of the starting up process or for the stopping down process. That is, in the above-mentioned example, the timer counter measuring 60 seconds is required other than that measuring 15 seconds.

For the power supply turning on process, as shown in FIG. 4, (A), the CPU 211 responds to the Peltier device driving turning on trigger (see FIG. 1, (A)), and then transmits the PWM signal of duty 10% to the FET 213, which controls the power supply from the power supply unit 101 in the PWM duty of 10%, and thus applies the driving voltage of 2.4 V to the Peltier device 301 via the coil 214 (Step S101).

At the same time as that of the output of the PWM duty 10%, the CPU 211 starts up the first-stage timer counter 212-1 (with the time interval setting of 15 seconds) which counts up by 1 second each (Step S102), and determines whether or not 15 seconds have elapsed from the starting up (whether or not the count value of the timer counter has reached 16 seconds) each time of the 1 second counting up operation (Step S103).

When the first-stage timer counter 212-1 has counted 15 seconds, the CPU 211 switches the driving voltage applied to the Peltier device 301 (Step S104). Specifically, the CPU 211 first disables the output of the PWM signal, increases the duty of the PWM signal further by 10% for further increasing the driving voltage by 2.4 V as a second voltage of 4.8 V, and then, enables the thus-updated PWM signal. Further, after the second-stage time counter 212-2 is started up (Step S102) and this timer counter has counted 15 seconds (Yes in Step S103), the setting of the PWM signal is again updated so that the duty is further increased by 10%, and thus, the applying voltage to the Peltier device 103 is increased further by 2.4 V so that 7.2 V is applied.

Thus, the duty of the PWM signal is increased by 10% at each elapse of 15 seconds. Then, after 60 seconds have elapsed from the turning on trigger (Yes in Step S105), that is, after the loop of Steps S102 through S104 is repeated three times, and the fourth-stage timer counter 212-4 reaches a time-up state, the setting of the duty of the PWM signal is increased to 50%, and the applying voltage to the Peltier device 301 reaches 12 V (Step S106). Then, the control flow for the turning on process is finished.

For the power supply turning off process, as shown in FIG. 4, (B), the CPU 211 responds to the Peltier device driving turning off trigger (see FIG. 2, (A)), and then transmits the PWM signal of the duty 40% to the FET 213, which controls the power supply from the power supply unit 101 in the PWM duty of 40%, and applies the driving voltage of 9.6 V after decaying down from 12 V by 2.4 V, to the Peltier device 301 via the coil 214 (Step S201).

At the same time as that of the output of the PWM duty 40%, the CPU 211 starts up the first-stage timer counter 212-1 (with the time interval setting of 15 seconds) which counts up by 1 second each (Step S202), and determines whether or not 15 seconds have elapsed from the starting up (whether or not the count value of the timer counter has reached 16 seconds) each time of the 1 second counting up operation (Step S203).

When the first-stage timer counter 212-1 has counted 15 seconds, the CPU 211 switches the driving voltage applied to the Peltier device 301 (Step S204). Specifically, the CPU 211 first disables the output of the PWM signal, decreases the duty of the PWM signal further by 10% for further decreasing the driving voltage by 2.4 V for a second voltage of 7.2 V, and then, enables the thus-updated PWM signal. Further, after the second-stage time counter 212-2 is started up (Step S202) and this timer counter has counted 15 seconds (Yes in Step S203), the setting of the PWM signal is again updated so that the duty is further decreased by 10%, and thus, the applying voltage to the Peltier device 103 is decreased further by 2.4 V so that 4.8 V is applied.

Thus, the duty of the PWM signal is decreased by 10% at each elapse of 15 seconds. Then, after 60 seconds have elapsed from the turning off trigger (Yes in Step S205), that is, after the loop of Steps S202 through S204 is repeated three times, and the fourth-stage timer counter 212-4 reaches a time-up state, the setting of the duty of the PWM signal is decreased to 0%, and the applying voltage to the Peltier device 301 finally reaches 0 V (Step S206). Then, the control flow for the turning off process is finished.

The above-mentioned second embodiment of the present invention is described now.

In this embodiment, as mentioned above, the PWM control manner is applied, in which the applying voltage for driving the Peltier device is changed.

In this manner, upon turning on or turning off of the power supply, the PWM duty is increased or decreased stepwise for a target value. In this control, a time interval for which each level of the applying voltage is output can be set arbitrarily as a control requirement, for the purpose of achieving the above-mentioned object of the present invention.

Figure 5:
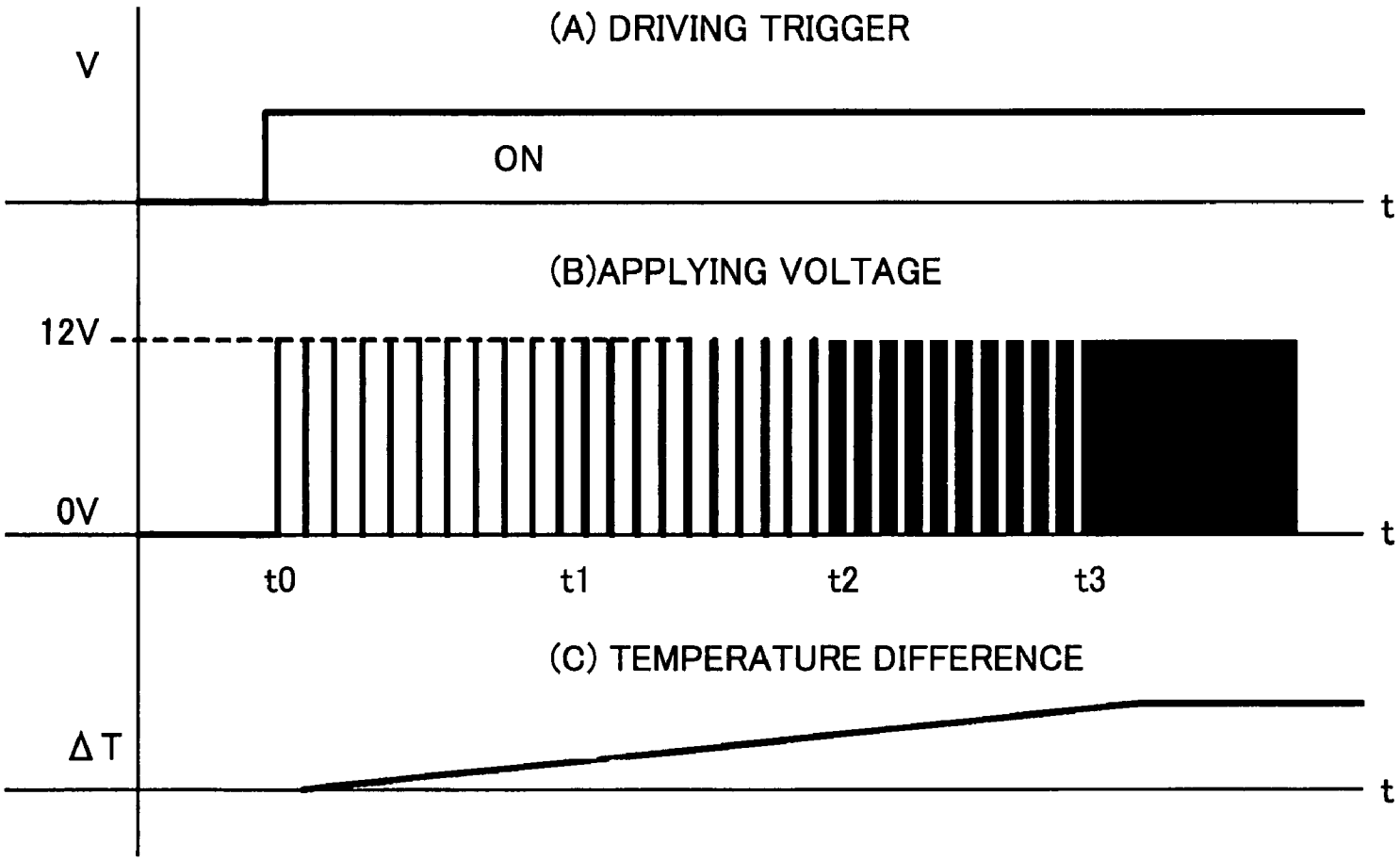
FIG. 5 illustrates a Peltier device driving method (upon power turning on) in a PWM control manner.

FIG. 5 illustrates operation according to the PWM control manner, specifically showing a time chart of a change in the applying voltage upon power supply tuning on, and a change of a temperature occurring in the Peltier device in response thereto. As shown in FIG. 5, (A), which shows a driving trigger signal for the Peltier device, a rising up (switching) of the driving trigger signal is applied as a trigger. FIG. 5, (B) shows the applying voltage (driving power) for driving the Peltier device. In this example, the PWM duty is increased stepwise by 25% each step for a final target value (100%). Thereby, the power value of the driving power increases stepwise, and thus, a temperature difference between the heat generating surface and the heat sink surface of the Peltier device increases accordingly. FIG. 5, (C) shows the temperature difference ΔT between the heat generating surface and the heat sink surface of the Peltier device.

By preventing this temperature difference ΔT from increasing sharply, it is possible to reduce a degradation occurring in the Peltier device, which is the object of the present invention. For this purpose, the output time interval for keeping each PWM duty of the applying voltage shown in FIG. 5, (B) every step is set appropriately in such a manner that the temperature changes ΔT may occur gently as shown in FIG. 5, (C). Then, operation according to the thus-obtained setting is carried out. Specifically, it is assumed that the above-mentioned trigger (rising up of the driving trigger signal shown in FIG. 5, (A)) occurs at a time t0, and respective times at which the PWM duty is switched to the subsequent one for increasing the PWM duty stepwise are t1, t2 and t3, as shown in FIG. 5, (B). For example, setting is made as follows: t1−t0=20 [secs]; t2−t1=15 [secs]; and t3−t2=10 [secs]. Thereby, it is possible to obtain a gentle increasing slope of the temperature difference ΔT as shown in FIG. 5, (C) in which the temperature difference is prevented from increased sharply. Thus, by increasing (changing) the power value of the driving power by the predetermined power value (by changing the PWM duty of the driving power) at each predetermined time interval, it is possible to obtain the desired gentle change of the temperature difference ΔT.

Figure 6:
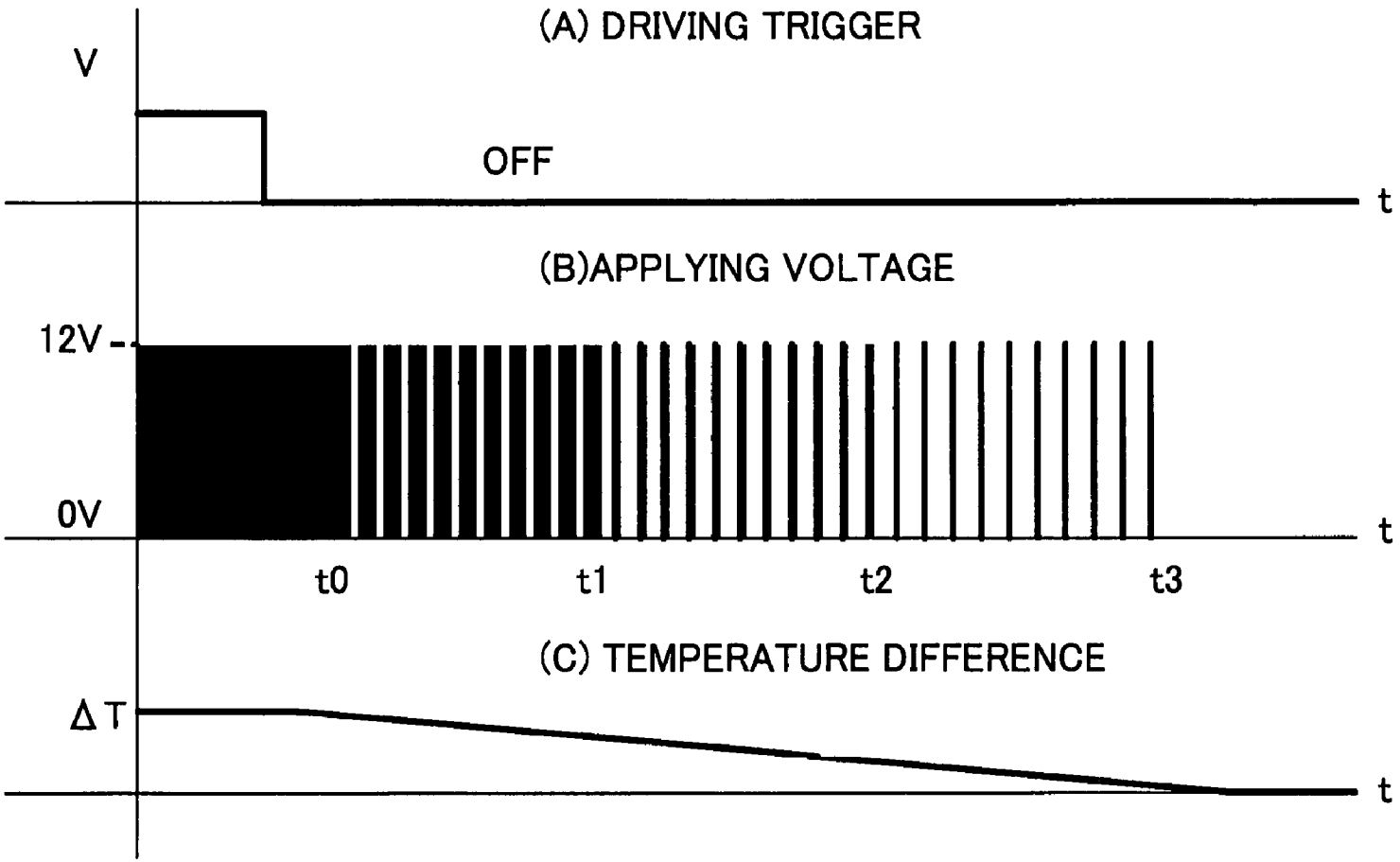
FIG. 6 illustrates a Peltier device driving method (upon power turning off) in a PWM control manner.

FIG. 6 illustrates operation according to the PWM control manner, specifically showing a time chart of a change in the applying voltage upon power supply tuning off, and a change of a temperature occurring in the Peltier device in response thereto. As shown in FIG. 6, (A), which shows a driving trigger signal for the Peltier device, a decaying down (switching) of the driving trigger signal is applied as a trigger. FIG. 6, (B) shows the applying voltage (driving power) for driving the Peltier device. In this example, the PWM duty is decreased stepwise by 25% for each step for a final target value (0%). Thereby, the power value of the driving power decreases stepwise, and thus, a temperature difference between the heat generating surface and the heat sink surface of the Peltier device decreases accordingly. FIG. 6, (C) shows the temperature difference ΔT between the heat generating surface and the heat sink surface of the Peltier device.

By preventing this temperature difference ΔT from decreasing sharply, it is possible to reduce a degradation occurring in the Peltier device, which is the object of the present invention. For this purpose, an output time interval for keeping each PWM duty of the applying voltage shown in FIG. 6, (B) every step is set appropriately in such a manner that the temperature changes ΔT may occur gently as shown in FIG. 6, (C). Then, operation according to the thus-obtained setting is carried out. Specifically, it is assumed that the above-mentioned trigger (decaying down of the driving trigger signal shown in FIG. 6, (A)) occurs at a time t0, and respective times at which the PWM duty is switched to the subsequent one for decreasing the PWM duty stepwise are t1, t2 and t3, as shown in FIG. 6, (B). For example, setting is made as follows: t1−t0=10 [secs]; t2−t1=15 [secs]; and t3−t2=20 [secs]. Thereby, it is possible to obtain a gentle decreasing slope of the temperature difference ΔT as shown in FIG. 6, (C) in which the temperature difference is prevented from decreasing sharply. Thus, by decreasing (changing) the power value of the driving power by the predetermined power value (by controlling the PWM duty of the driving power) at each predetermined time interval, it is possible to obtain the desired gentle change of the temperature difference ΔT.

Figure 7:
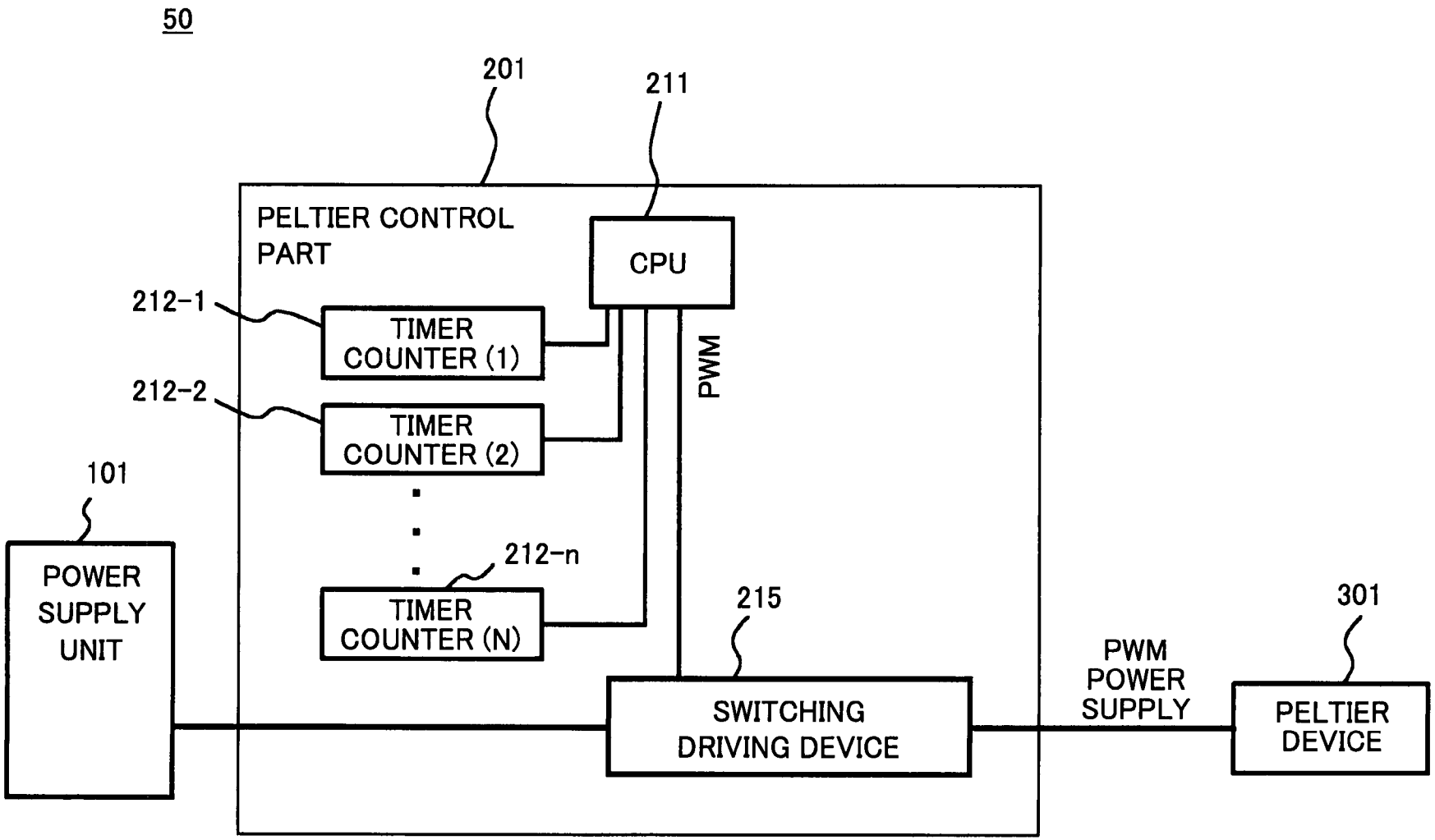
FIG. 7 shows an embodiment of a driving part of a Peltier apparatus in the PWM control manner.

FIG. 7 shows an embodiment of a Peltier device driving part in a Peltier apparatus for carrying out the above-described operation (see FIGS. 5 and 6) according to the above-described PWM control manner.

As shown in FIG. 7, the driving part of the Peltier apparatus includes a power supply unit 101 and a Peltier control part 201. The Peltier control part 201 controls a driving DC voltage supplied by the power supply unit 101 for the purpose of providing the driving voltage with the variable PWM duty for driving the Peltier device 301. That is, the driving power supplied by the power supply unit 101 to the Peltier device 101 is controlled as mentioned above. The Peltier control part 201 includes a control part including a CPU 211 and timer counters 212-1 through 212-n corresponding to the respective PWM duty steps; and a switching driving device 215 controlled by a control signal from the CPU 211 to apply the driving voltage to the Peltier device 301 in the PWM manner.

The CPU 211 includes, as well-known in the art for achieving a control function in various types of electronic apparatuses, a ROM or a RAM (not shown) under the control of the CPU, and executes instructions written in a program provided for controlling driving of the Peltier device 301. When power supply is turned on and the electronic apparatus is started up, or the electronic apparatus is stopped down by turning off of the power supply, the Peltier apparatus is started up or stopped down accordingly. For this purpose, an instruction is provided to the Peltier apparatus. In response thereto, the CPU 211 starts up the program for executing instructions written in the control program stored in the ROM, for example, a program for carrying out a control flow (see FIG. 8) for applying the driving voltage to the Peltier device 301 in the PWM manner as described later. Then, the CPU 211 controls driving of the Peltier device 301 according to the program.

Operation of controlling the driving power applied to the Peltier device 301 in the Peltier control part 201 in the PWM manner is as follows: The predetermined PWM signal is output to the switching driving device 215 according to the control program, and, then, according to the duty of the PWM signal, the switching driving device 215 carries out switching operation and thus modulates the power supply provided to the Peltier device 205. Thus, the driving power applied to the Peltier device 301 is controlled as mentioned above.

At this time, according to the second embodiment of the present invention, each output time interval of a respective PWM duty step for modulating the power supply applied to the Peltier device 301 is controlled. For this purpose, the timer counters 212-1 through 212-n are provided for counting or measuring the respective ones of the output time intervals corresponding to the number of the respective PWM duty steps corresponding to the output steps (n times). A time interval setting can be made for each timer counter to an arbitrary value. The CPU 211 manages the output time for each PWM duty of the above-mentioned stepwise control of the PWM duty (see FIG. 5 or 6) by means of the group of the timer counters 212-1 through 212-n, and thus, the CPU 211 can control a time interval for which each PWM duty step.

This group of the timer counters 212-1 through 212-n are applied for the starting up process (see FIG. 1) and the down stopping process (FIG. 2). However, since these processes should not occur simultaneously, it is possible to apply the timer counter group in common for these processes. For example, as in the example of FIGS. 5, (B) and 6, (B), in which the respective time intervals are common for these processes, the timer counters can be applied without changing the time interval settings. Thereby, it is possible to simplify the system.

A control flow of driving the Peltier device 301 carried out by the CPU 211 of the above-described control part 50 shown in FIG. 7 according to the control program is described now.

Figure 8:
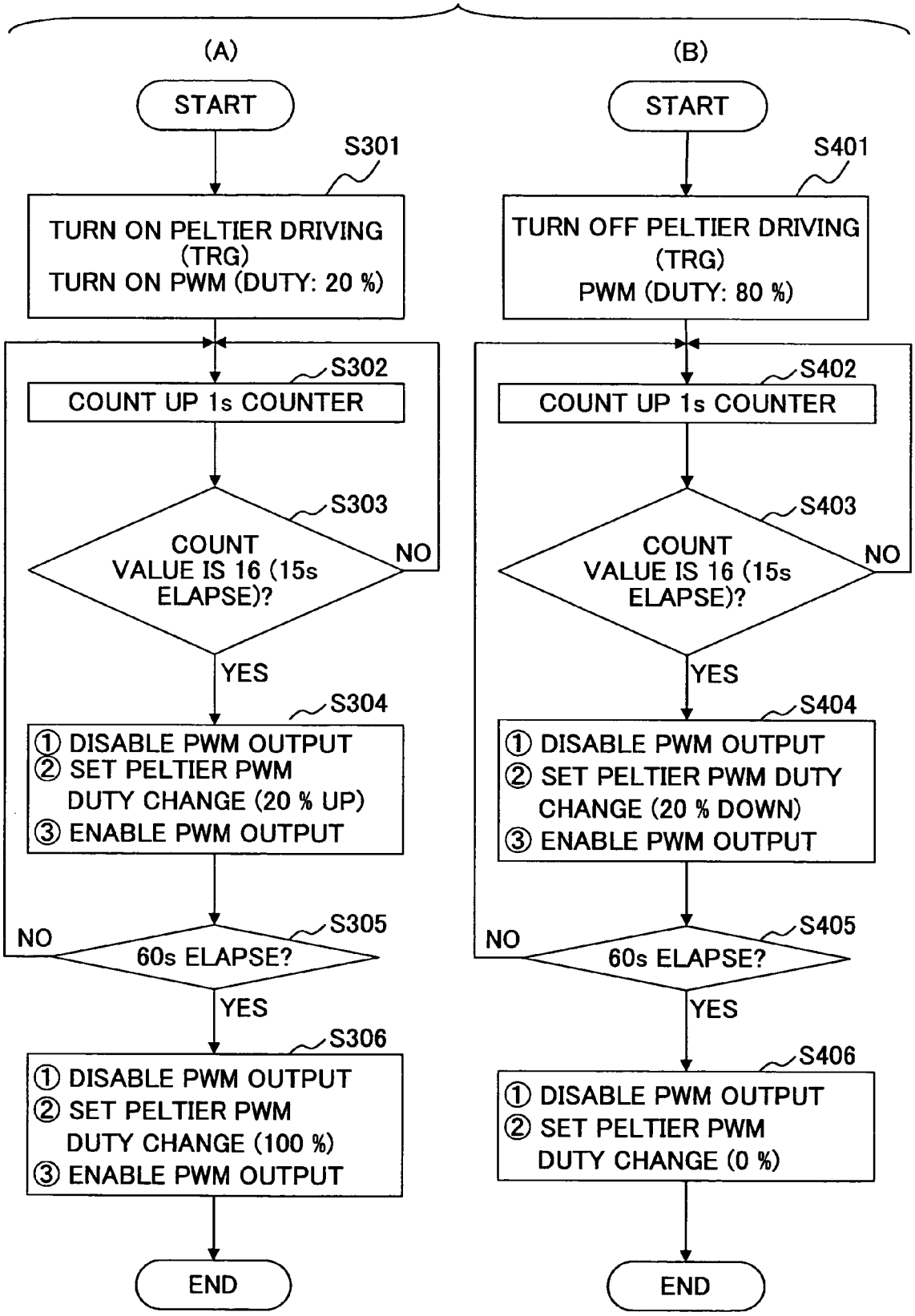
FIG. 8 shows a Peltier device driving control operation flow chart in the PWM control manner.

FIG. 8 shows the control flow of driving the Peltier device 301. FIG. 8, (A) shows the control flow for the power supply turning on process while FIG. 8, (B) shows the control flow for the power supply turning off process.

As described above, in the Peltier device driving method in the present embodiment, the PWM duty is controlled so as to control the driving power applied the Peltier device 301. Specifically, the PWM duty is changed 20% every step, and then, the duty of 100% is set for a completely started up state while the duty of 0% is set for a completely stopped down state. Further, the respective times at which the duty of the PWM signal is switched (t1, t2 and t3 in the example of FIG. 6, (B) or FIG. 6, (B)) are set in such a manner that each switching is carried out at a time interval of 15 seconds. Accordingly, the completely starting up is achieved for a total 60 seconds from the turning on trigger or the completely stopping down is achieved for a total 60 seconds from the turning off trigger. In the present embodiment, the respective times at which the duty of the PWM signal, i.e., t1, t2, t3, . . . tn are obtained from the respective settings of the timer counters 212-1 through 212-n, provided for the number of the output steps. However, for a case where the time interval between the applying voltage switching operations is fixed as 15 seconds every step as mentioned above, it is possible to apply a common timer counter therefor. However, in such a case, another timer counter is required for setting the completion timing of the starting up process or for the stopping down process. That is, in the above-mentioned example, the timer counter measuring 60 seconds is required other than that measuring 15 seconds.

For the power supply turning on process, as shown in FIG. 8, (A), the CPU 211 responds to the Peltier device driving turning on trigger (see FIG. 5, (A)), and then transmits the PWM signal of the duty 20% to the switching driving device 215, which controls the power supply from the power supply unit 101 in the PWM duty of 20%, and applies the driving power to the Peltier device 301 (Step S301).

At the same time as that of the output of the PWM duty 20%, the CPU 211 starts up the first-stage timer counter 212-1 (with the time interval setting of 15 seconds) which counts up by 1 second every step (Step S302), and determines whether or not 15 seconds have elapsed from the starting up (whether or not the count value of the timer counter has reached 16 seconds) each time of the 1 second counting up operation (Step S303).

When the first-stage timer counter 212-1 has counted 15 seconds, the CPU 211 switches the PWM duty of the driving power applied to the Peltier device 301 (Step S304). Specifically, the CPU 211 first disables the output of the PWM signal, increases the duty of the PWM signal further by 20% for 40%, and then, enables the thus-updated PWM signal. Further, after the second-stage time counter 212-2 is started up (Step S302) and this timer counter has counted 15 seconds (Yes in Step S303), the setting of the PWM signal is again updated so that the PWM duty is further increased by 20% so that the PWM duty of 60% is applied Thus, the duty of the PWM signal is increased by 20% at each elapse of 15 seconds. Then, after 60 seconds have elapsed from the turning on trigger (Yes in Step S305), that is, after the loop of Steps S302 through S304 is repeated three times, and the fourth-stage timer counter 212-4 reaches a time-up state, the setting of the duty of the PWM signal is made by which the power supply to the Peltier device 301 is increased to 100% (Step S306). Then, the control flow for the turning on process is finished.

For the power supply turning off process, as shown in FIG. 8, (B), the CPU 211 responds to the Peltier device driving turning off trigger (see FIG. 6, (A)), and then transmits the PWM signal of the duty 80% to the FET 213, which controls the power supply from the power supply unit 101 in the PWM duty of 80%, thus decayed from 100% by 20%, to the Peltier device 301 (Step S401).

At the same time as that of the output of the PWM duty 80%, the CPU 211 starts up the first-stage timer counter 212-1 (with the time interval setting of 15 seconds) which counts up by 1 second each step (Step S402), and determines whether or-not 15 seconds have elapsed from the starting up (whether or not the count value of the timer counter has reached 16 seconds) each time of the 1 second counting up operation (Step S403).

When the first-stage timer counter 212-1 has counted 15 seconds, the CPU 211 switches the PWM duty for controlling the driving power applied to the Peltier device 301 (Step S404). Specifically, the CPU 211 first disables the output of the PWM signal, decreases the duty of the PWM signal further by 20% for 60%, and then, enables the thus-updated PWM signal. Further, after the second-stage time counter 212-2 is started up (Step S302) and this timer counter has counted 15 seconds (Yes in Step S403), the setting of the PWM signal is again updated so that the duty is further decreased by 20%, and thus, the driving power applied to the Peltier device 103 is decreased further by 20% for 40%

Thus, the duty of the PWM signal is decreased by 20% at each elapse of 15 seconds. Then, after 60 seconds have elapsed from the turning off trigger (Yes in Step S405), that is, after the loop of Steps S402 through S404 is repeated three times, and the fourth-stage timer counter 212-4 reaches a time-up state, the setting of the duty of the PWM signal for controlling the driving power applied to the Peltier device 301 is decreased finally to 0% (Step S406). Then, the control flow for the turning off process is finished.

A third embodiment of the present invention is described.

In this embodiment, the Peltier apparatus in the first or the second embodiment described above is actually applied in the electronic apparatus.

Since a cooing apparatus as the Peltier apparatus described above applying the Peltier device may have a effectively reduced size, and includes no mechanical moving element, such a cooling apparatus is suitable for avoiding temperature rise otherwise occurring due to a heat generated by circuit devices or such, a temperature or a humidity is thus controlled within a housing of an electronic apparatus and thus, an adequate operation environment can be kept, in the electronic apparatus in which an IC circuit, an electronic component, an electric unit or such for which a temperature or a humidity should be kept to a predetermined level is mounted in a narrow space within the housing. In the third embodiment, as an embodiment which can be preferably applied as such an electronic apparatus, a Peltier apparatus such as that according to the first or second embodiment described above is applied as a temperature control system or a humidity control system which may be mounted in the electronic apparatus.

Figure 9:
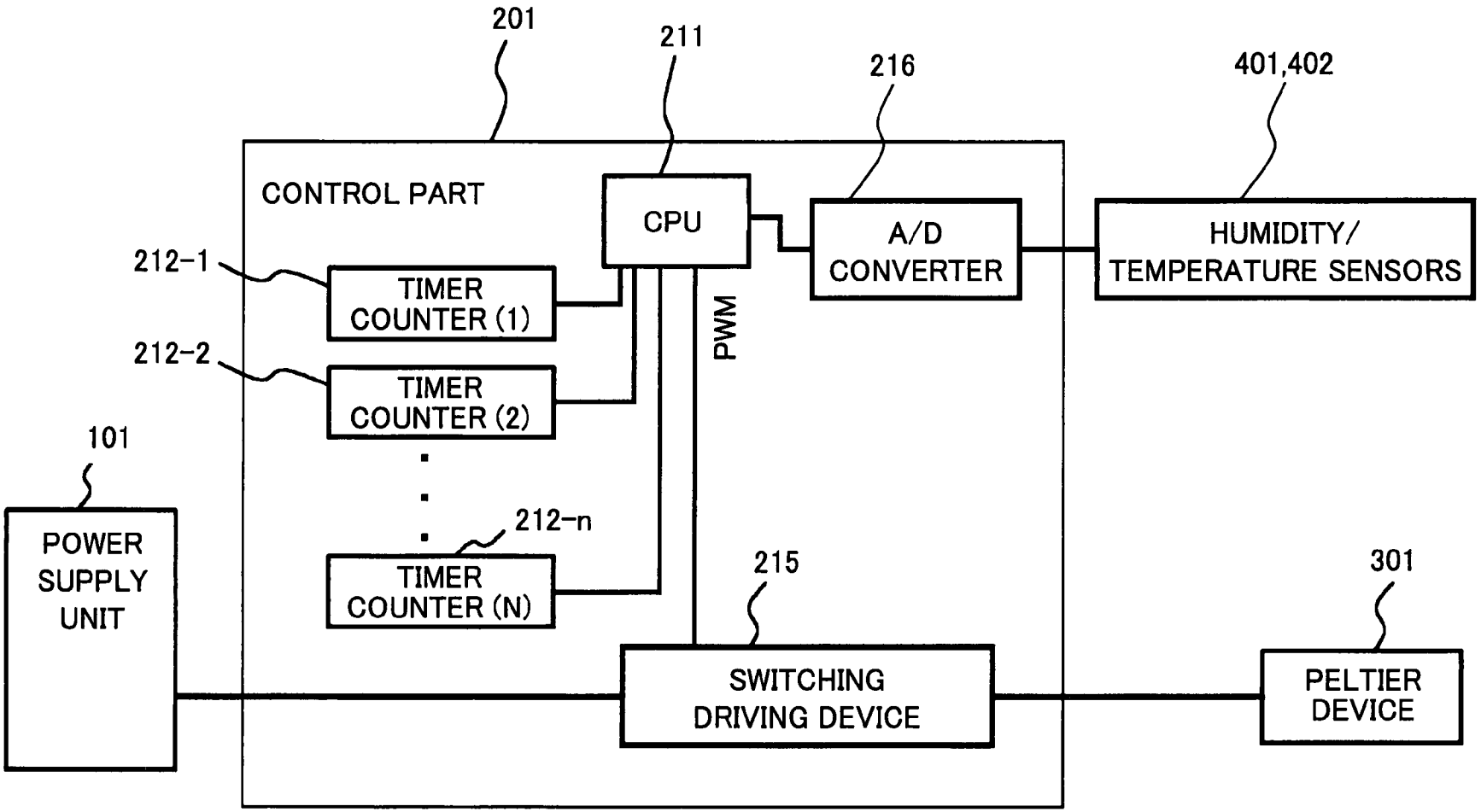
FIG. 9 shows a block diagram of a humidity/temperature-control system employing the Peltier apparatus.

FIG. 9 shows a block diagram of a humidity/temperature control system according to the third embodiment. It is noted that a temperature control system and a humidity control system have configurations basically the same as one another although a control target is different between the temperature environment and the humidity environment, and thus, which sensor, a temperature sensor or a humidity sensor, should be applied is different. Accordingly, hereinafter, a general expression 'temperature/humidity' is applied for the purpose of simplification.

In the system shown in FIG. 9, humidity/temperature sensors 401, 402 for detecting a humidity or a temperature of an operation environment to be controlled and an A/D converter 216 are added to the Peltier apparatus (FIG. 7) according to the second embodiment. Detection signals of the humidity/temperature sensors 401, 402 are converted into digital signals by means of the A/D converter 216, and then are input to the CPU 211. The CPU 211 executes humidity/temperature control according to a control program, and, with the use of an additional sub-sequence of the control program, carries out control of driving the Peltier device 301. The CPU 211 may be a common one also used to control the entirety of the electronic apparatus, or may be one specially provided for controlling the Peltier apparatus part of the electronic apparatus.

Operation of the humidity/temperature control system shown in FIG. 9 is described now. The CPU 211 has the detection values of the humidity/temperature sensors 401, 402 fed back thereto via the A/D converter 216, and, based on the thus-obtained humidity/temperature information (detection results), the CPU 211 obtains an error thereof from a target value (an adequate humidity/temperature range). Therewith, the CPU 211 controls driving of the Peltier apparatus by turning on or turning off of the same (on-off control). In this on-off control, the driving control for the turning on process is carried out as shown in FIG. 4, (A) or FIG. 8, (A); or, the driving control for the turning off process is carried out as shown in FIG. 4, (B) or FIG. 8, (B), according to the first or the second embodiment described above.

Further, a hysteresis is provided between an upper limit and a lower limit in the target value applied for the on-off control operation. In other words, a hysteresis is provided between a turning-on trigger threshold and a turning-off trigger threshold. By thus providing the hysteresis between the upper limit and the lower limit, it is possible to reduce the number of times of the on-off control operations. As a result, it is possible to elongate the operation life of the Peltier device 301.

Figure 16:
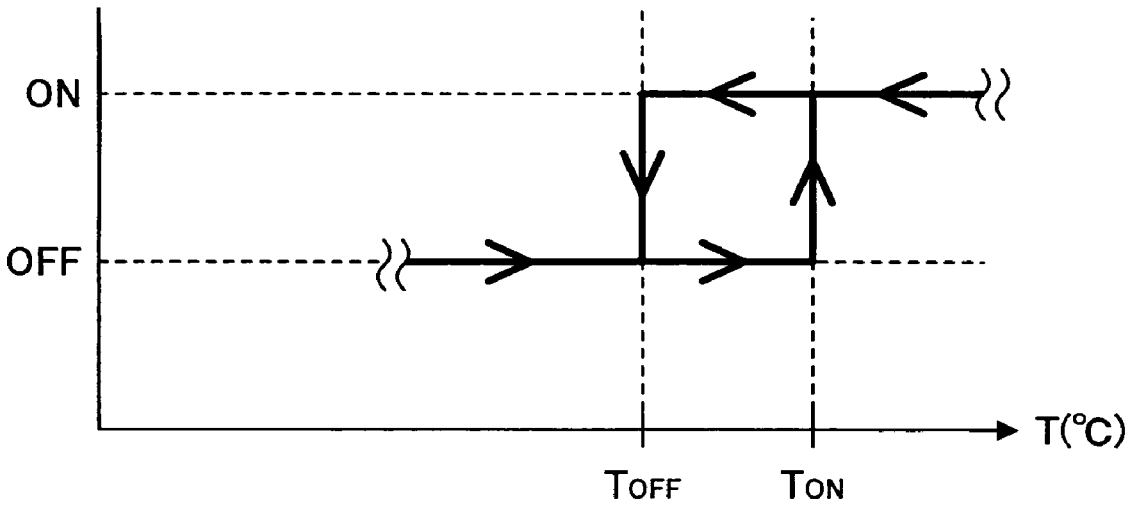
FIG. 16 shows a hysteresis curve applicable in an on-off control of a Peltier apparatus according to the present invention.

FIG. 16 shows one example of the hysteresis provided between the turning-on threshold $T_{ON}$ and the turning-off threshold $T_{OFF}$. In this scheme, the Peltier apparatus is turned on when the detected temperature increases and then reaches the turning-on threshold $T_{ON}$. On the other hand, the Peltier apparatus is turned off when the detected temperature decreases and then reaches the turning-off threshold $T_{OFF}$.

A fourth embodiment of the present invention is described now.

According to the fourth embodiment, the control function of the above-described third embodiment is improved.

According to the third embodiment described above, a humidity/temperature environment can be controlled for a fixed condition with the use of a cooling function of the Peltier device. However, by feeding air which is once cooled by the Peltier device or dried air by means of a fan so as to rapidly change the operation environment, and also, by changing air flow of the fan depending on a power supply amount to the Peltier device 301, it is possible to further improve the efficiency.

Figure 10:
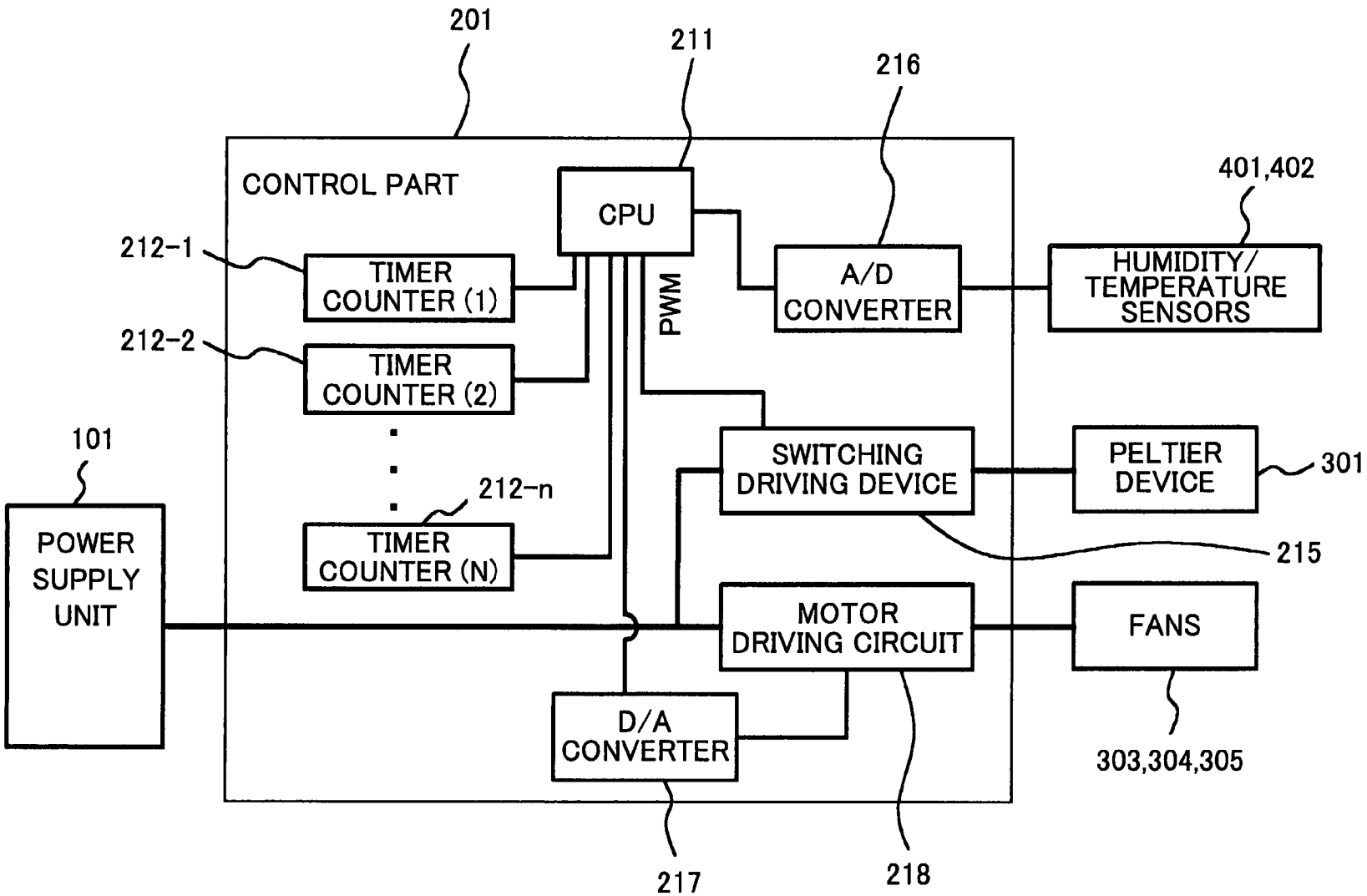
FIG. 10 shows a block diagram of another example of a humidity/temperature control system employing the Peltier apparatus.

FIG. 10 shows a block diagram of a humidity/temperature control system according to the fourth embodiment. In the system shown in FIG. 10, fans 303, 304 and 305, a motor driving circuit 218 and a D/A converter 217 are added to the humidity/temperature control system shown in FIG. 9 according to the third embodiment. As a result of controlling the fan motor control circuit 218, air flows of the fans are controlled. At this time, the air flows are controlled depending on the power supply amount to the Peltier device 301. Specifically, the CPU 211 outputs a control instruction for controlling revolving speeds of the fans, which is determined depending on the power supply amount to the Peltier device 305, for example, the PWM duty value mentioned above for controlling the driving power to the Peltier device. The control instruction is converted into an analog value by the D/A converter 217, which is then input to the motor driving circuit 218. The CPU 211 executes humidity/temperature control according to a control program, and, with the use of an additional sub-sequence of the control program, carries out control of driving the Peltier device 301. The CPU 211 may be a common one also used for controlling the entirety of the electronic apparatus, or may be one specially provided for controlling the Peltier apparatus part of the electronic apparatus.

Operation of the humidity/temperature control system shown in FIG. 10 is described now. The CPU 211 has the detection values of the humidity/temperature sensors 401, 402 fed back thereto via the A/D converter 216, and, based on the thus-obtained humidity/temperature information (detection results), the CPU 211 obtains an error thereof from a target value (an adequate humidity/temperature range). Therewith, the CPU 211 controls driving of the Peltier apparatus by turning on or turning off thereof (on-off control). In this on-off control, the driving control for the turning on process is carried out as shown in FIG. 4, (A) or FIG. 8, (A); or the driving control for the turning off process is carried out as shown in FIG. 4, (B) or FIG. 8, (B), according to the first or the second embodiment described above.

At the same time of carrying out the on-off control, the CPU 211 reduces the fans' air flows by providing a control instruction to the fan motor control circuit 218 to lower the revolution speeds thereof, when the power supply to the Peltier device 301 is reduced (that is, when the applying voltage becomes low or the PWM duty is reduced). There, the D/A converter 217 is applied to control the motor driving circuit 218 for controlling the revolution speeds of the fans with the analog value. However, any other well-known method may be applied to control the revolution speeds of the fans.

A fifth embodiment of the present invention is described.

In the fifth embodiment, the temperature control system applying the Peltier apparatus as in the above-described fourth embodiment is applied to an image forming apparatus.

As mentioned above, the temperature control system according to the fourth embodiment is suitable to control temperature or such within an electronic apparatus in which IC circuits, electronic parts, electric components or such are assembled in a narrow space, and to keep proper operation environment thereof. According to the fifth embodiment, as the above-mentioned electronic apparatus to which the temperature control system according to the present invention can be suitably applied, an image forming apparatus is applied for example. The image forming apparatus may be an electrophotographic color laser printer, a copier (i.e., an apparatus in which optical writing is-carried out on a photosensitive body by means of a laser, and an electrostatic latent image thus produced is developed by means of toner) or such. In the fifth embodiment, the temperature control system according to the present invention is applied to control a temperature environment of a laser diode in a writing unit used to expose the photosensitive body.

Figure 11:
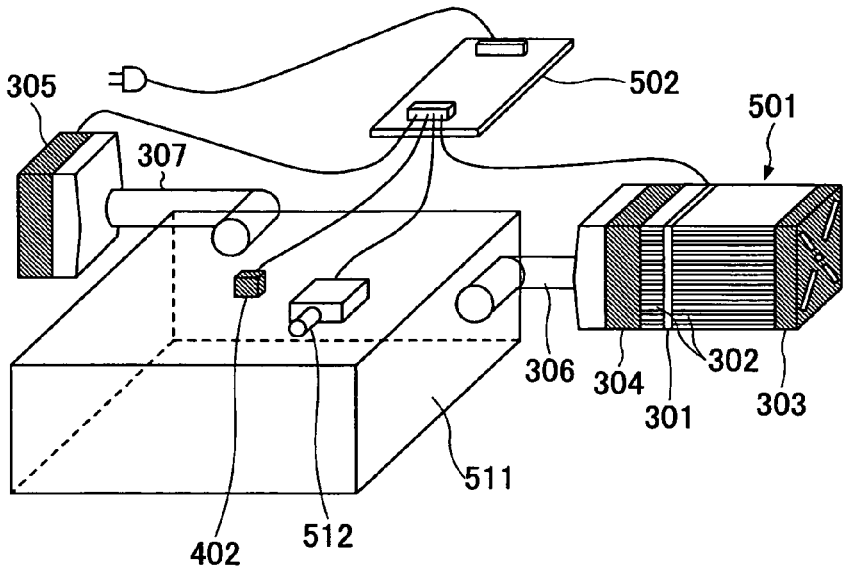
FIG. 11 shows a general configuration of a temperature control system applied for a writing unit of an image forming apparatus.

FIG. 11 shows a general configuration of the temperature control system according to the fifth embodiment. A basic configuration and function of such an image forming apparatus such as a color laser printer, a copier or such itself is well-known, and thus, parts/components other than those necessary to describe the configuration of the present embodiment are omitted.

In FIG. 11, the control target is a temperature environment in a writing unit 511, in which a laser diode 512 is loaded for which a temperature environment should be controlled for a fixed condition.

The temperature control system in this embodiment includes a Peltier part 501, a control part (control substrate) 502 supplying power to the Peltier part 501, and a temperature sensor 402 and so forth connected to the control part 502. The control part 502 has a configuration the same as that of the fourth embodiment (see FIG. 10).

The Peltier part 501 has a configuration in which heat radiating fins 302 and fans 303, 304 are provided on both sides of a Peltier device 301. When a voltage is applied to the Peltier device 301, heat is generated from a heat generating surface of the Peltier device 301, which heat is discharged to the outside of the machine by the fan 303. On the other hand, low-temperature air generated from a heat sink surface of the Peltier device 301 is injected to the writing unit 511 via a duct 306 by means of the fan 304. Further, high-temperature air in the writing unit 511 is discharged via a duct 307 by means of a fan 305. The temperature in the writing unit 511 is monitored by means of the temperature sensor 402. Based on the detection result of the temperature sensor 402, a CPU of the control part 502 controls the Peltier part 501, so that the temperature environment of the laser diode 512 in the writing unit 511 can be controlled for a fixed condition. By thus controlling the temperature environment of the laser diode 512, it is possible to avoid a degradation of the laser diode 512, and also, to avoid a writing position error otherwise occurring due to a temperature change.

The control target is not limited to the temperature environment of the laser diode 512. Other than it, it is possible to apply the same control method for controlling environments of various types of sensors, provided in such a type of an image forming apparatus, which sensors require well-controlled temperature environments.

The various types of sensors as the control targets may include the following sensors, for example:

A photosensor which is applied in control of conveyance of original paper or transfer paper, that is, an object detecting sensor in a non-contact type including an LED and a photodiode or a phototransistor;

A toner adhesion detecting sensor, i.e., a sensor detecting a toner density adhering to the photosensitive body, to a medium such as transfer paper or such. With the use of its detection result, appropriate correction is made, and thus, the image quality is improved.

A color drift sensor. That is, in a tandem-type color image forming apparatus or such, a color drift (positional error) among respective colors is detected. With the use of its detection result, appropriate correction is made, and thus, the image quality is improved.

By keeping temperature environments of these sensors by means of the above-mentioned temperature control system according to the present invention, it is possible to obtain stable detection outputs, and, with the use thereof, the image forming operation can be kept in an adequate condition.

A sixth embodiment of the present invention is described next.

In the sixth embodiment, the humidity control system applying the Peltier apparatus as in the above-described fourth embodiment is applied to the image forming apparatus.

In the sixth embodiment, different from the above-described fifth embodiment, a humidity environment of the photosensitive body unit of the image forming apparatus such as an electrophotographic color laser printer or a copier is controlled by means of the humidity control system according to the present invention.

Figure 12:
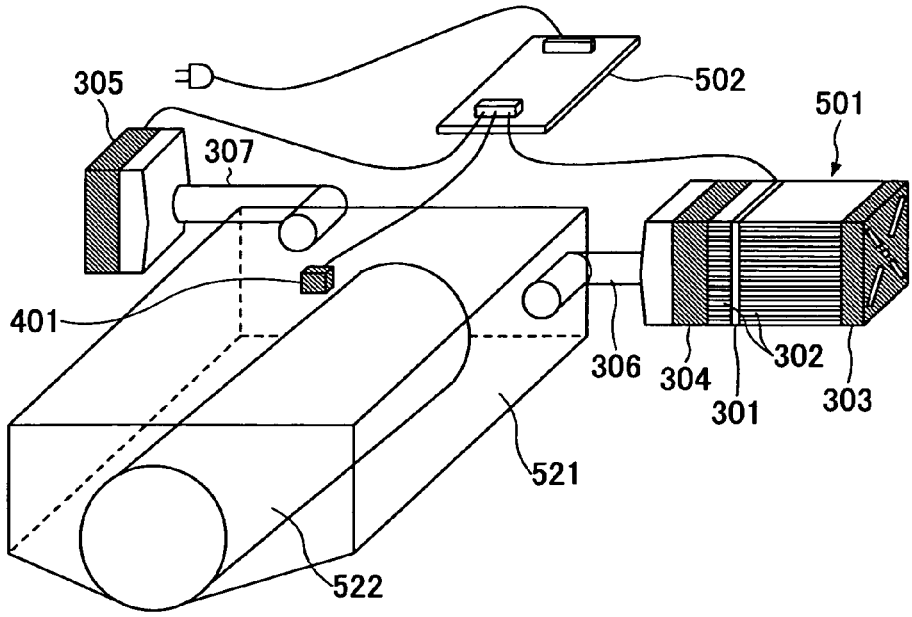
FIG. 12 shows a general configuration of a humidity control system applied for a photosensitive body unit of an image forming apparatus.

FIG. 12 shows a general configuration of the humidity control system according to the sixth embodiment.

In FIG. 12, the control target is a humidity environment in a photosensitive body unit 521, in which the photosensitive body 522 is loaded for which a humidity environment should be controlled for a fixed condition.

The humidity control system in this embodiment includes a Peltier part 501, a control part (control substrate) 502 supplying power to the Peltier part 501, and a humidity sensor 401 and so forth connected to the control part 502. The control part 502 has a configuration the same as that of the fourth embodiment (see FIG. 10).

The Peltier part 501 has a configuration in which heat radiating fins 302 and fans 303, 304 are provided on the both sides of a Peltier device 301. When a voltage is applied to the Peltier device 301, heat is generated from a heat generating surface of the Peltier device 301, which heat is discharged to the outside of the machine by the fan 303. On the other hand, air around a heat sink surface of the Peltier device 301 is cooled and thus dried. The thus-obtained dried air is injected to the photosensitive body unit 521 via a duct 306 by means of the fan 304. Further, humid air in the photosensitive body unit 521 is discharged via a duct 307 by means of a fan 305. The humidity in the photosensitive body unit 521 is monitored by means of the humidity sensor 402. Based on the detection result of the humidity sensor 402, a CPU of the control part 502 controls the Peltier part 501, so that the humidity environment of the photosensitive body 522 in the photosensitive body unit 521 can be controlled for a fixed condition.

A seventh embodiment of the present invention is described next.

Also in the seventh embodiment, the humidity control system applying the Peltier apparatus as in the above-described fourth embodiment is applied to the image forming apparatus.

In the seventh embodiment, different from the above-described fifth embodiment, a humidity environment of a transfer paper tray of the image forming apparatus such as an electrophotographic color laser printer or a copier is controlled by means of the humidity control system according to the present invention.

Figure 13:
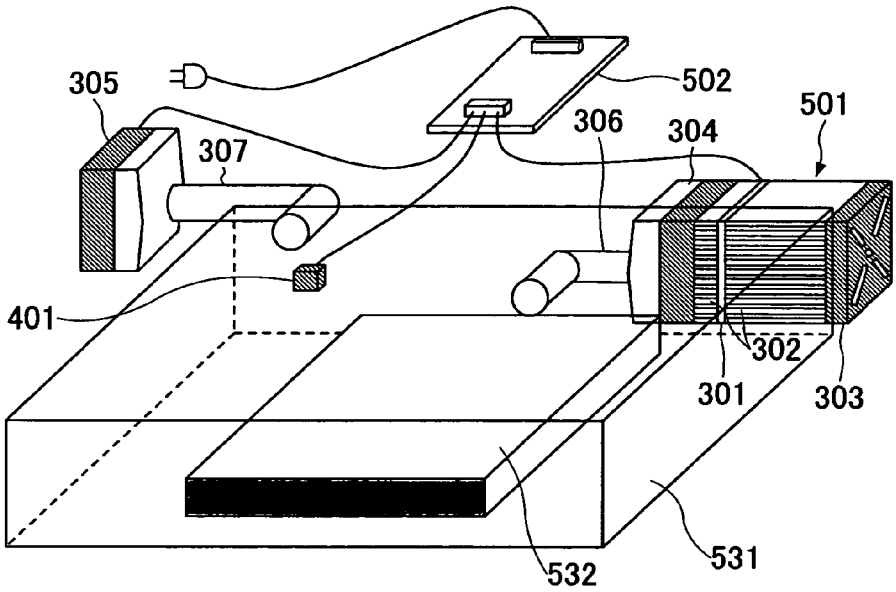
FIG. 13 shows a general configuration of a humidity control system applied for a transfer paper tray of an image forming apparatus.

FIG. 13 shows a general configuration of the humidity control system according to the seventh embodiment.

In FIG. 13, the control target is a humidity environment in the transfer paper tray 531, in which transfer paper 532 is loaded for which a humidity environment should be controlled for a fixed condition.

The humidity control system in this embodiment includes a Peltier part 501, a control part (control substrate) 502 supplying power to the Peltier part 501, and a humidity sensor 401 and so forth connected to the control part 502. The control part 502 has a configuration the same as that of the fourth embodiment (see FIG. 10).

The Peltier part 501 has a configuration in which heat radiating fins 302 and fans 303, 304 are provided on both sides of a Peltier device 301. When a voltage is applied to the Peltier device 301, heat is generated from a heat generating surface of the Peltier device 301, which heat is discharged to the outside of the machine by the fan 303. On the other hand, air around a heat sink surface of the Peltier device 301 is cooled and thus dried. The thus-obtained dried air is injected to the transfer paper tray 531 via a duct 306 by means of the fan 304. Further, humid air in the transfer paper tray 531 is discharged via a duct 307 by means of a fan 305. The humidity in the transfer paper tray 531 is monitored by means of the humidity sensor 402. Based on the detection result of the temperature sensor 402, a CPU of the control part 502 controls the Peltier part 501, so that the humidity environment of the transfer paper 532 in the transfer paper tray 531 can be controlled for a fixed condition.

An eighth embodiment of the present invention is described next.

In the eighth embodiment, the temperature control system applying the Peltier apparatus as in the above-described fourth embodiment is applied to the image forming apparatus.

In the eighth embodiment, different from the above-described fifth embodiment, temperature environment of a fixing device of the image forming apparatus such as an electrophotographic color laser printer or a copier is controlled by means of the temperature control system according to the present invention.

Figure 14:
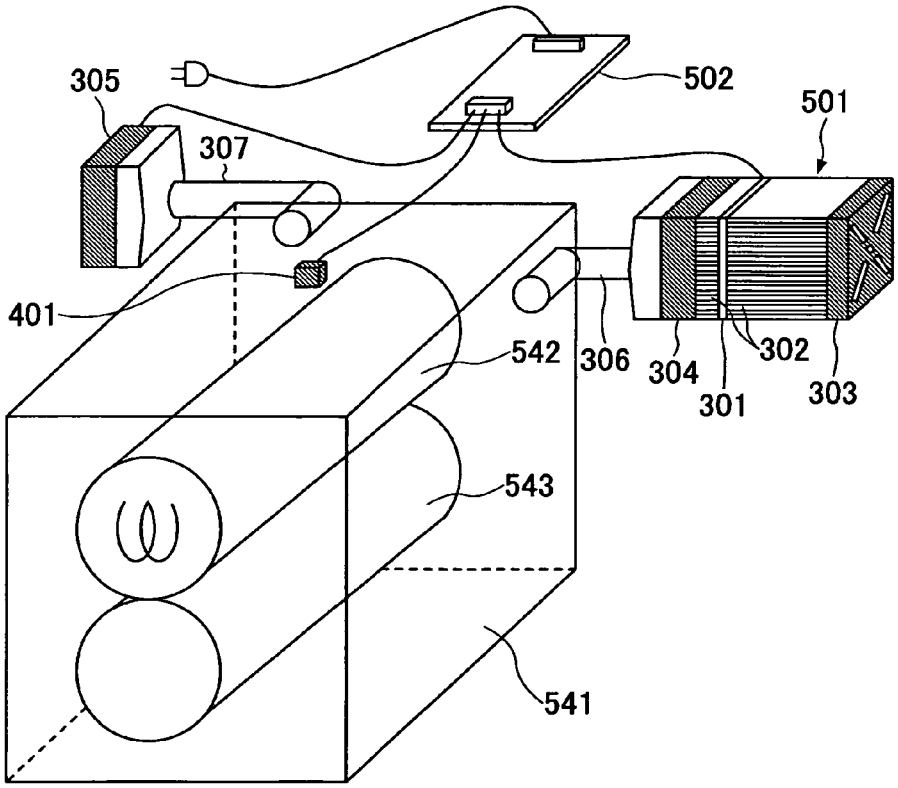
FIG. 14 shows a general configuration of a temperature control system applied for a fixing unit of an image forming apparatus.

FIG. 14 shows a general configuration of the temperature control system according to the eighth embodiment.

In FIG. 14, the control target is a temperature environment in the fixing device 541, in which heating rollers 542 and 543 are loaded for which a temperature environment should be controlled to a fixed condition.

The temperature control system in this embodiment includes a Peltier part 501, a control part (control substrate) 502 supplying power to the Peltier part 501, and a temperature sensor 402 and so forth connected to the control part 502. The control part 502 has a configuration the same as that of the fourth embodiment (see FIG. 10).

The Peltier part 501 has a configuration in which heat radiating fins 302 and fans 303, 304 are provided on both sides of a Peltier device 301. When a voltage is applied to the Peltier device 301, heat is generated from a heat generating surface of the Peltier device 301, which heat is discharged to the outside of the machine by the fan 303. On the other hand, low-temperature air generated from a heat sink surface of the Peltier device 301 is injected to the fixing device 541 via a duct 306 by means of the fan 304. Further, high-temperature air in the fixing device 541 is discharged via a duct 307 by means of a fan 305. The temperature in the fixing device 541 is monitored by means of the temperature sensor 402. Based on the detection result of the temperature sensor 402, a CPU of the control part 502 controls the Peltier part 501, so that the temperature environment of the heating roller 542 in the fixing device 541 can be controlled for a fixed condition.

Figure 15:
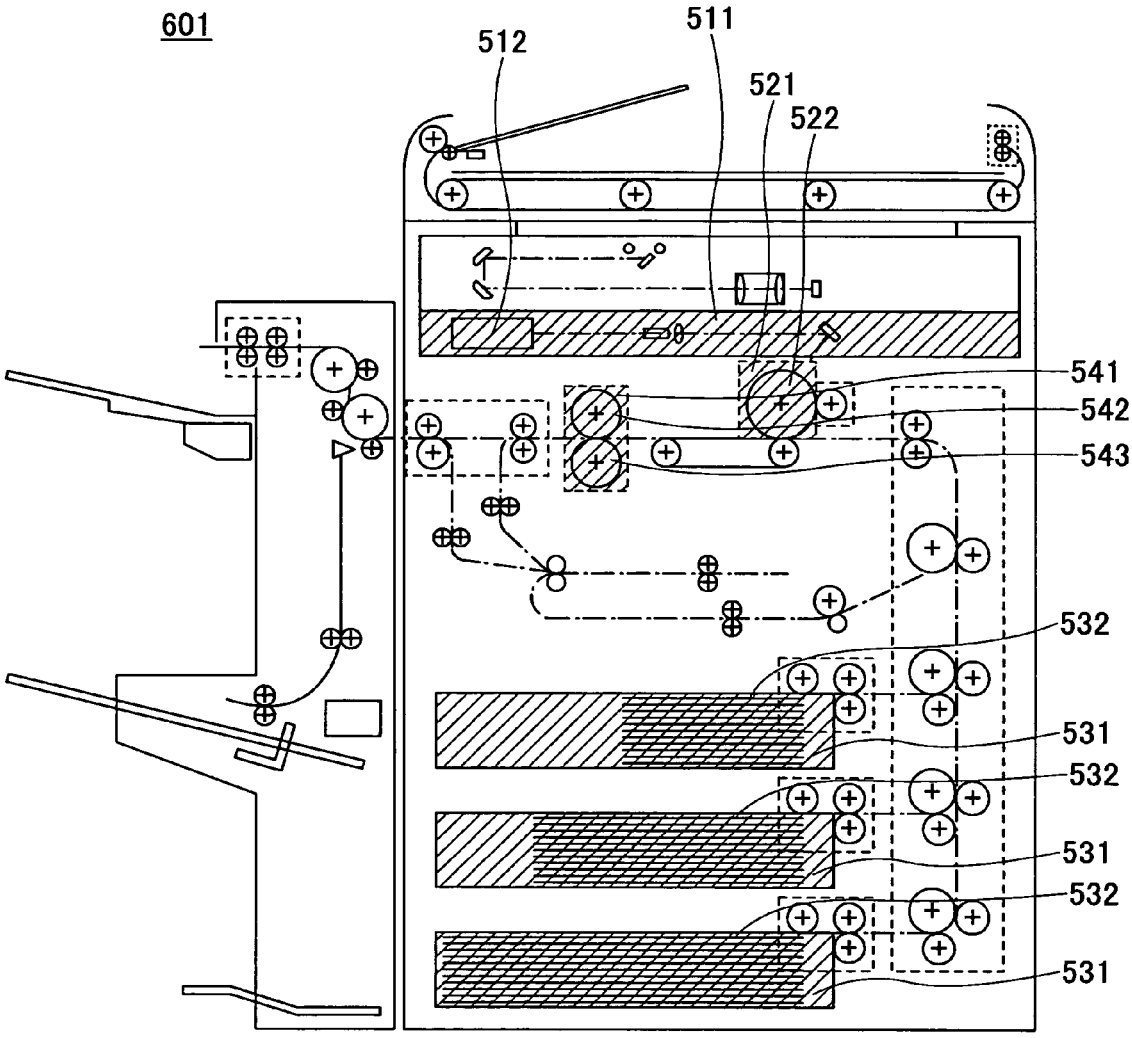
FIG. 15 shows a copier as a specific example of the image forming apparatus to which the present invention may be applied.

FIG. 15 shows a copier 601 corresponding to a specific example of the image forming apparatus according to any one of the above-described sixth through eighth embodiments of the present invention. The copier 601 shown includes the writing unit 511 (in which the laser diode 512 is loaded) of FIG. 11, the photosensitive body unit 521 (in which the photosensitive body 522 is loaded) of FIG. 12, the transfer paper tray 531 (in which the transfer paper 532 is loaded) of FIG. 13 and the fixing device 541 (in which the heating rollers 542 and 543 are loaded) of FIG. 14.

Further, the present invention is not limited to the above-described embodiments, and variations and modifications may be made without departing from the basic concept of the present invention claimed below.

The present application is based on Japanese Priority Applications Nos. 2004-125572 and 2005-110214, filed on Apr. 21, 2004 and Apr. 6, 2005, respectively, the entire contents of which are hereby incorporated herein by reference.

What is claimed is:

1. A cooling apparatus of supplying driving power to a cooling element from a power supply unit, comprising:

a plurality of timer counters counting respective time durations, in sequence; and a driving power changing part configured to change, in a step-wise manner, a power value of the driving power supplied to said cooling element from the power supply unit, by a predetermined power value at each predetermined time interval, the power value being held at substantially constant levels in respective duty steps of corresponding time durations, respectively, wherein for each duty step, an output time interval of the duty step is controlled based on an output of a corresponding one of the plurality of time counters.

2. The cooling apparatus as claimed in claim 1, wherein:

said driving power changing part changes the power value of the driving power by changing a voltage value of the driving power.

3. The cooling apparatus as claimed in claim 1, wherein:

said driving power changing part changes the power value of the driving power by changing a PWM duty of the driving power.

4. The cooling apparatus as claimed in claim 1, wherein:

said driving power changing part increases or decreases die power value of the driving power by the predetermined power value at each predetermined time interval, so as to increase or decrease a temperature difference between a heat generating surface and a heat sink surface of the cooling element.

5. The cooling apparatus as claimed in claim 1, wherein:

said driving power changing part responds to a switching of a driving signal between turning on and turning off, to start change of the power value of the driving power, and thus increases or decrease the power value of the driving power by the predetermined power value at each predetermined time interval.

6. The cooling apparatus as claimed in claim 1, further comprising a measuring part measuring a time elapse, wherein:

said driving power changing part changes the power value of the driving power by the predetermined power value at each predetermined time interval according to a measurement result of said measuring part.

7. The cooling apparatus as claimed in claim 6, wherein:

said measuring part comprises a plurality of stages of measuring parts which measure a plurality of predetermined time intervals in sequence.

8. The cooling apparatus as claimed in claim 6, wherein:

said measuring part is applied in common for both increasing the driving power and decreasing the driving power.

9. The cooling apparatus as claimed in claim 1, wherein:

said cooling element comprises a Peltier device.

10. A method executed by a cooling apparatus which supplies driving power to a cooling element from a power supply unit, said method comprising:

a step duration counting step of counting, through a plurality or timer counters, respective time durations, in sequence; and a driving power changing step of changing, in a stepwise manner, a power value of the driving power supplied to said cooling element from the power supply unit, by a predetermined power value at each predetermined time interval, the power value being held at substantially constant levels in respective duty steps of corresponding time durations, respectively, wherein for each duty step, an output time interval of the duty step is controlled based on an output of a corresponding one of the plurality of time counters.

11. The method as claimed in claim 10, further comprising a measuring step of measuring a time elapse, wherein:

in said driving power changing step, the power value of the driving power is changed by the predetermined power value at each predetermined time interval according to a measurement result of said measuring step.

12. The method as claimed in claim 10, wherein:

said cooling element comprises a Peltier device.

13. A computer readable medium tangibly embodying a program of instructions executable by a computer to perform a method to control a cooling apparatus which supplies driving power to a cooling element from a power supply unit, said method comprising:

a step duration counting step of counting, through a plurality of timer counters, respective time durations, in sequence; and a driving power changing step of changing, in a stepwise manner, a power value of the driving power supplied to said cooling element from the power supply unit, by a predetermined power value at each predetermined time interval, the power value being held at substantially constant levels in respective duty steps of corresponding time durations, respectively, wherein for each duty step, an output time interval of the duty step is controlled based on an output of a corresponding one of the plurality of time counters.

14. The computer readable medium claimed in claim 13, wherein said method further comprises a measuring step of measuring a time elapse, and wherein in said driving power changing step, the power value of the driving power is changed by the predetermined power value at each predetermined time interval according to a measurement result of said measuring step.

15. The computer readable medium claimed in claim 13, wherein said cooling element comprises a Peltier device.

16. An electronic apparatus comprising:

the cooling apparatus claimed in claim 1, said cooling apparatus maintaining a predetermined operation environment for the electronic apparatus;

a sensor detecting the operation environment; and a control part controlling a driving manner of said cooling apparatus based on a detection result of said sensor.

17. The electronic apparatus as claimed in claim 16, wherein:

said control part turns on and turns off said cooling apparatus so as to control a detection value or said sensor for a target value.

18. The electronic apparatus as claimed in claim 17, wherein:

said control part carries out follow-up operation for the target value with a predetermined hysteresis between a turning-on-trigging threshold and a turning-off-triggering threshold.

19. The electronic apparatus as claimed in claim 17, wherein:

said sensor comprises a humidity sensor or a temperature sensor; and said electronic apparatus further comprises a device for changing a humidity environment or a temperature environment by transmitting a heat effect provided by said cooling apparatus into the humidity environment or the temperature environment.

20. The electronic apparatus as claimed in claim 19, wherein:

said device for changing the humidity environment or the temperature environment comprises a fan; and said electronic apparatus further comprises a device for changing driving power of a motor driving said fan depending on the driving power of said cooling apparatus.

21. The electronic apparatus as claimed in claim 19, wherein:

said electronic apparatus comprises an image forming apparatus; and the operation environment to be controlled with the use of said cooling apparatus comprises at least any one of a temperature environment of a laser diode, a temperature environment of an optical sensor, a temperature environment of a toner adhesion amount detecting sensor, a temperature environment of a color drift sensor, a humidity environment of a photosensitive body, a humidity environment of a recording paper tray and a temperature environment of a fixing device.

* * * * *